US006701114B2

(12) United States Patent
Sekine et al.

(10) Patent No.: US 6,701,114 B2
(45) Date of Patent: Mar. 2, 2004

(54) IMAGE FORMING APPARATUS AND IMAGE FORMING PROCESS UNIT WITH DEVELOPER CARRIED ON A DEVELOPER CARRIER

(75) Inventors: Takeyoshi Sekine, Tokyo (JP); Hiroshi Ikeguchi, Saitama (JP); Tsukuru Kai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/041,582

(22) Filed: Jan. 10, 2002

(65) Prior Publication Data

US 2002/0094216 A1 Jul. 18, 2002

(30) Foreign Application Priority Data

Jan. 16, 2001 (JP) ..... 2001-007510

(51) Int. Cl.[7] ..... G03G 15/09

(52) U.S. Cl. ..... 399/267; 399/236; 399/270; 399/272; 399/274; 399/277

(58) Field of Search ..... 399/267, 277, 399/270, 272, 274, 236; 430/122

(56) References Cited

U.S. PATENT DOCUMENTS

| | | | | |
|---|---|---|---|---|
| 4,766,458 A | * | 8/1988 | Oka et al. | 399/236 |
| 5,109,254 A | | 4/1992 | Oka et al. | |
| 5,227,842 A | | 7/1993 | Hayashi et al. | |
| 5,327,199 A | | 7/1994 | Sekine | |
| 5,416,568 A | | 5/1995 | Yoshiki et al. | |
| 5,557,382 A | | 9/1996 | Tatsumi et al. | |
| 5,598,254 A | | 1/1997 | Ikesue et al. | |
| 5,734,953 A | | 3/1998 | Tatsumi | |
| 5,758,241 A | * | 5/1998 | Oyama et al. | 399/272 |
| 5,765,079 A | | 6/1998 | Yoshiki et al. | |
| 5,774,772 A | | 6/1998 | Kai et al. | |
| 5,828,935 A | | 10/1998 | Tatsumi et al. | |

(List continued on next page.)

FOREIGN PATENT DOCUMENTS

| | | |
|---|---|---|
| EP | 0 738 937 | 10/1996 |
| EP | 1 030 229 | 8/2000 |
| JP | 5-40410 | 2/1993 |
| JP | 6-194961 | 7/1994 |
| JP | 10-31364 | 2/1998 |
| JP | 10-48958 | 2/1998 |
| JP | 11-72998 | 3/1999 |
| JP | 2000-231258 | 8/2000 |
| JP | 2000-305360 | 11/2000 |

*Primary Examiner*—Joan Pendegrass
(74) *Attorney, Agent, or Firm*—Oblon, Spivak, McClelland, Maier & Neustadt, PC

(57) ABSTRACT

An image forming apparatus of the present invention includes a developing device including a rotatable, nonmagnetic developer carrier and a magnetic field forming device. In a developing region where the developer carrier faces an image carrier, the magnetic field forming device causes a developer made up of toner and magnetic grains to rise on the developer carrier in the form of a magnet brush. In the developing region, the magnet brush on the developer carrier is caused to move at a higher speed than the surface of the image carrier in the same direction as and in contact with the surface of the image carrier, thereby developing the latent image. The toner of the developer is magnetic toner. Flux density set up in the developing region outside of the surface of the developer carrier in a normal direction has an attenuation ratio of 50% or above.

69 Claims, 19 Drawing Sheets

U.S. PATENT DOCUMENTS

| | | | |
|---|---|---|---|
| 5,887,224 | A | 3/1999 | Mizuishi et al. |
| 5,915,143 | A | 6/1999 | Watanabe et al. |
| 5,915,155 | A | 6/1999 | Shoji et al. |
| 6,006,050 | A | 12/1999 | Watanabe et al. |
| 6,055,388 | A | 4/2000 | Watanabe et al. |
| 6,081,684 | A | 6/2000 | Naganuma et al. |
| 6,125,243 | A | 9/2000 | Shoji et al. |
| 6,208,826 | B1 | 3/2001 | Yoshinaga et al. |
| 6,266,501 | B1 | 7/2001 | Mizuishi et al. |
| 6,295,437 | B1 | 9/2001 | Hodoshima et al. |
| 6,335,137 | B1 | 1/2002 | Suzuki et al. |
| 6,337,957 | B1 | 1/2002 | Tamaki et al. |
| 6,366,751 | B1 | 4/2002 | Shakuto et al. |
| 6,385,423 | B1 | 5/2002 | Kai |
| 6,403,275 | B1 | 6/2002 | Kuramoto et al. |
| 6,442,364 | B2 | 8/2002 | Kai et al. |
| 6,449,452 | B1 | 9/2002 | Kai |
| 6,456,806 | B2 | 9/2002 | Shoji et al. |
| 6,468,706 | B2 | 10/2002 | Matsuda et al. |
| 6,505,014 | B2 | 1/2003 | Aoki et al. |
| 6,507,718 | B2 | 1/2003 | Ohjimi et al. |

* cited by examiner

*Fig. 13*

| | |
|---|---|
| <MAGNET ROLLER> | |
| DIAMETER | $\phi$16mm |
| NUMBER OF POLES | 6 |
| PEAK FLUX DENSITY OF MAIN POLE | 68mT |
| <TONER> | |
| VOLUME MEAN GRAIN SIZE | 7.2μm |
| MAGNETIC SUBSTANCE CONTENT | 23% BY MASS |
| ADDITIVE : SILICA | 0.50% BY MAS |
| TITANIUM OXIDE | 0.25% BY MAS |
| <MAGNETIC CARRIER> | |
| VOLUME MEAN GRAIN SIZE | 50μm |
| <DEVELOPING CONDITIONS> | |
| GAP Gp | 0.30mm |
| DOCTOR GAP Gd | 0.32mm |
| SCOOP AMOUNT | 60mg/cm² |
| DRUM DIAMETER | Φ30mm |
| DRUM LINEAR VELOCITY | 120mm/sec |
| SLEEVE LINEAR VELOCITY RATIO (TO DRUM) | 2.46 |
| SLEEVE LINEAR VELOCITY | 295.2mm/sec |
| CONTROL TONER CONTENT TC | 10% BY MAS |
| <LATENT IMAGE CONDITIONS> | |
| BACKGROUND POTENTIAL VD | 900V |
| IMAGE POTENTIAL VL | 100V |
| BIAS VB | 700V |

Fig. 20

| TONER CONTENT | TONER SCATTERING | BACKGROUND CONTAMINATION | CARRIER DEPOSITION | DEVELOPING ABILITY |
|---|---|---|---|---|
| 3% BY MASS | ◎ | ◎ | × | × (SHORT ID) |
| 4% BY MASS | ◎ | ◎ | ○ | 2.3 |
| 5% BY MASS | ◎ | ◎ | ○ | 2.4 |
| 6% BY MASS | ◎ | ◎ | ○ | 2.6 |
| 8% BY MASS | ◎ | ◎ | ○ | 2.8 |
| 10% BY MASS | ◎ | ◎ | ○ | 3.0 |
| 12% BY MASS | ◎ | ◎ | ○ | 3.2 |
| 15% BY MASS | ◎ | ○ | ○ | 3.4 |
| 18% BY MASS | ○ | ○ | ○ | 3.5 |
| 20% BY MASS | ○ | ○ | ○ | 3.6 |
| 22% BY MASS | × | × | ○ | 3.7 |
| 25% BY MASS | × | × | ○ | 3.7 |

*Fig. 21*

| MAGNETIC SUBSTANCE CONTENT | TONER SCATTERING | DEVELOPING ABILITY |
|---|---|---|
| 0% BY MASS | × | 3.5 |
| 5% BY MASS | × | 3.5 |
| 10 % BY MASS | ○ | 3.3 |
| 20 % BY MASS | ◎ | 3.1 |
| 30 % BY MASS | ◎ | 2.8 |
| 40% BY MASS | ◎ | 2.5 |
| 50% BY MASS | ◎ | 2.3 |
| 60% BY MASS | ◎ | 2.1 |

IMAGE FORMING APPARATUS AND IMAGE FORMING PROCESS UNIT WITH DEVELOPER CARRIED ON A DEVELOPER CARRIER

BACKGROUND OF THE INVENTION

1. Field of the Invention

The present invention relates to a copier, printer, facsimile apparatus or similar image forming apparatus and an image forming process unit removably mounted thereto. More particularly, the present invention relates to a developing device included in the image forming apparatus or the image forming process unit. The developing device is of the type including a rotatable, nonmagnetic developer carrier and means for forming a magnetic field that causes a developer made up of toner and magnetic grains to rise on the developer carrier in the form of a magnet brush in a developing region where the developer carrier faces an image carrier.

2. Description of the Background Art

Generally, an electrophotographic image forming apparatus includes an image carrier implemented as a photoconductive drum or a photoconductive belt. A developing device develops a latent image electrostatically formed on the image carrier to thereby produce a corresponding toner image. It is a common practice with this type of image forming apparatus to use either one of a one-ingredient type developer or toner and a two-ingredient type developer, i.e., a mixture of toner and magnetic grains. Development using the two-ingredient type developer features desirable image transferability and desirable developing characteristics against temperature and humidity. The two-ingredient type developer forms brush chains on a developer carrier in a developing region where the developer carrier faces an image carrier. The toner is fed from the developer on the developer carrier to a latent image formed on the image carrier.

As for development using the two-ingredient type developer, a decrease in the distance between the image carrier and the developer carrier in the developing region allows high image density to be easily attained and reduces the so-called edge effect. This, however, is apt to cause the trailing edge of a black solid image or that or a halftone solid image to be lost. Let this undesirable phenomenon be referred to as the omission of a trailing edge hereinafter. Further, horizontal thin lines appear smaller in width than vertical thin lines when developed. In addition, solitary dots are unstable in shape when developed.

To solve the above problems, Japanese Patent Laid-Open Publication No. 2000-305360, for example, proposes to limit a flux density distribution on a developing sleeve in a direction normal to the sleeve. The limited flux density distribution reduces the width of a developing region, or nip width, in the direction of rotation of the sleeve or increases the developer density of a magnet brush in the developing region.

On the other hand, assume that use is made of nonmagnetic toner. Then, when a developing sleeve rotates, the resulting centrifugal force is apt to cause the toner deposited on the sleeve to fly about. While the nonmagnetic toner may be replaced with magnetic toner, not only usual, electrostatic attraction but also a magnetic force that urges the magnetic toner away from the photoconductive drum act between the toner and the magnetic grains. This again brings about the defects stated earlier.

Technologies relating to the present invention are also disclosed in, e.g., Japanese Patent Laid-Open Publication Nos. 5-40410, 10-48958, 11-72998, and 2000-231258.

SUMMARY OF THE INVENTION

It is an object of the present invention to provide a developing device capable of obviating the scattering of toner and the omission of a trailing edge and other defects even when a developer carrier moves at a high linear velocity.

It is another object of the present invention to provide an image forming apparatus including the developing device.

It is still another object of the present invention to provide an image forming process unit including the developing device.

It is a further object of the present invention to provide an image forming apparatus including the image forming process unit.

An image forming apparatus of the present invention includes a developing device including a rotatable, nonmagnetic developer carrier and a magnetic field forming device. In a developing region where the developer carrier faces an image carrier, the magnetic field forming device causes a developer made up of toner and magnetic grains to rise on the developer carrier in the form of a magnet brush. In the developing region, the magnet brush on the developer carrier is caused to move at a higher speed than the surface of the image carrier in the same direction as and in contact with the surface of the image carrier, thereby developing the latent image. The toner of the developer is magnetic toner. Flux density set up in the developing region outside of the surface of the developer carrier in a normal direction has an attenuation ratio of 50% or above.

An image forming process unit having the above configuration is also disclosed.

BRIEF DESCRIPTION OF THE DRAWINGS

The above and other objects, features and advantages of the present invention will become more apparent from the following detailed description taken with the accompanying drawings in which:

FIG. 13 is a table listing experimental conditions applied to Example 1 of the illustrative embodiment;

FIG. 20 is a table listing experimental results of Example 4;

FIG. 21 is a table listing experimental results of Example 5;

DESCRIPTION OF THE PREFERRED EMBODIMENT

Figure 1:
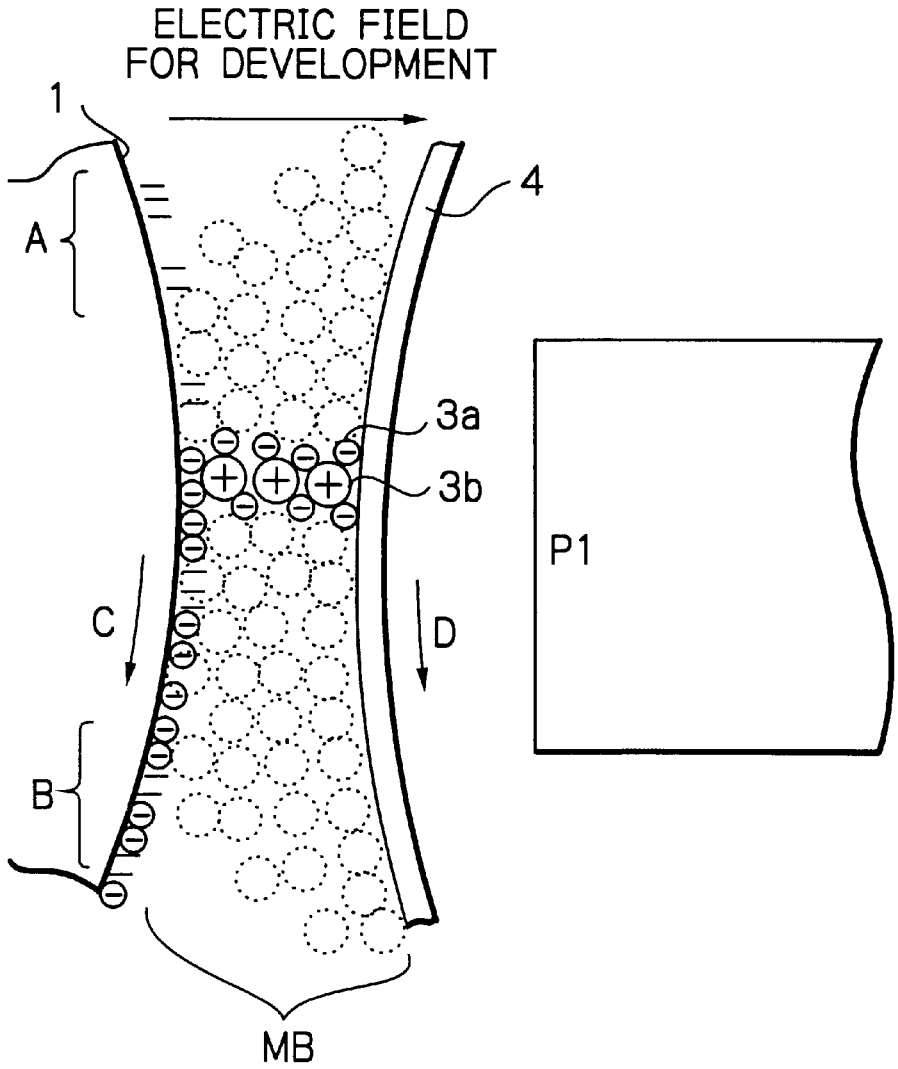
Fig. 1 PRIOR ART
FIG. 1 is a fragmentary view showing a developing section included in a negative-to-positive developing device using a two-ingredient type developer.

To better understand the present invention, the emission of a trailing edge will be described more specifically hereinafter. FIG. 1 shows a specific configuration of a developing section included in a conventional negative-to-positive developing device of the type using a two-ingredient type developer. In FIG. 1, small circles 3*a* and large circles 3*b* are representative of toner grains and magnetic carrier grains, respectively. Also, only one of brush chains is indicated by solid lines while the other brush chains are indicated by phantom lines with toner grains thereof being omitted. Further, assume that a non-image area A on a photoconductive drum 1 is charged to negative polarity.

As shown in FIG. 1, a sleeve or developer carrier 4 is rotated in a direction indicated by an arrow D. The sleeve 4 conveys a developer deposited thereon to a developing region where the sleeve 4 faces the drum 1. A magnetic pole P1 causes the developer reached the developing region to rise in the form of a magnet brush MB. The drum 1 carrying a latent image thereon is rotated in a direction indicated by an arrow C. The linear velocity of the sleeve 4 is higher than the linear velocity of the drum 1. As a result, at the developing region, the magnet brush MB rubs itself against the latent image. Consequently, the toner grains 3*a* are transferred from the sleeve 4 to an image area B on the drum 1 under the action of an electric field. The toner grains 3*a* develop the latent image at the downstream side of the developing region in the direction of rotation of the sleeve 4. Generally, the sleeve 4 is rotated at a higher linear velocity than the drum 1 in order to guarantee preselected image density.

Figure 2A:
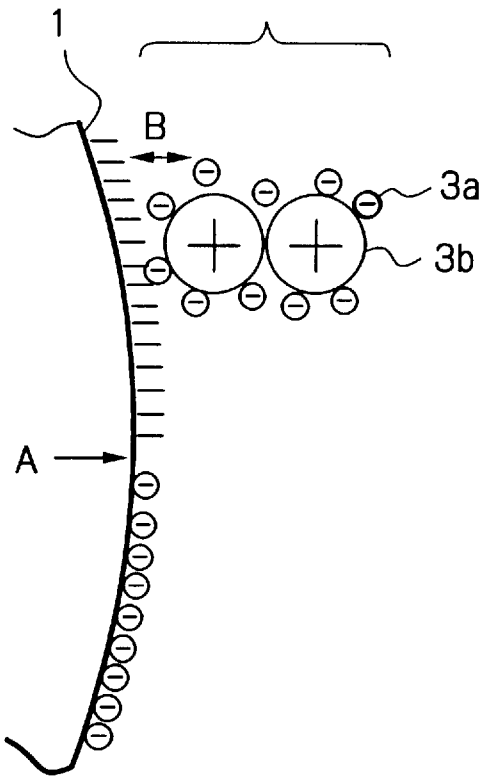
Fig. 2A PRIOR ART
FIGS. 2A through 2C are fragmentary views demonstrating a mechanism that brings about the omission of a trailing edge.
Figure 2B:
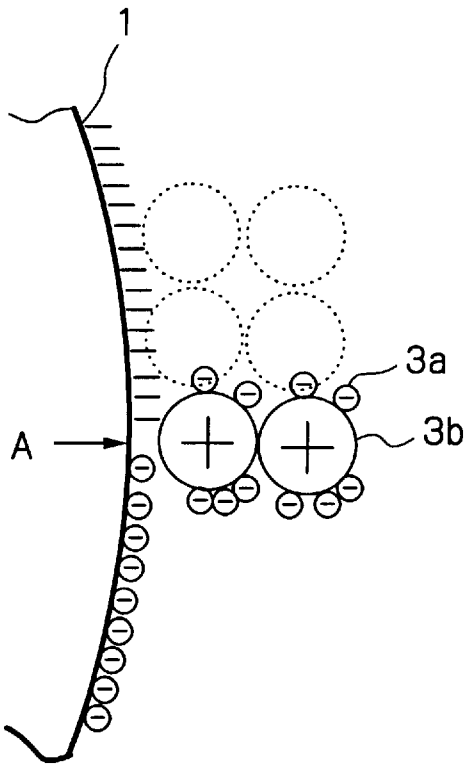
Fig. 2B PRIOR ART
Figure 2C:
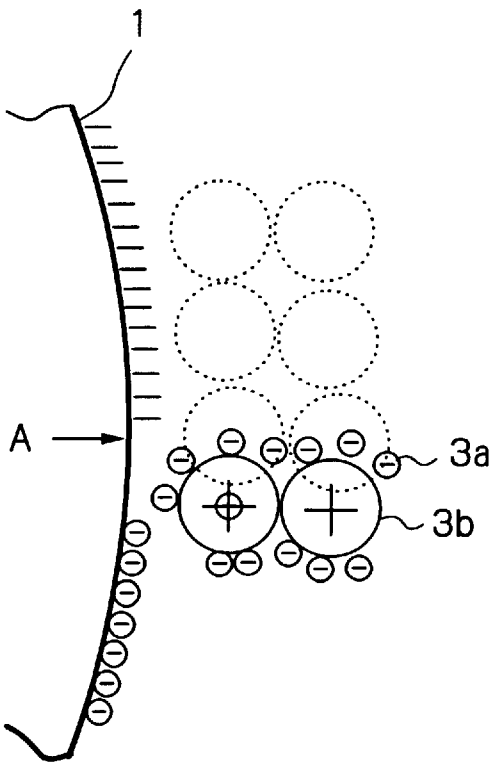
Fig. 2C PRIOR ART

FIGS. 2A through 2C demonstrate a mechanism presumably causing the trailing edge of a toner image to be lost in the above-described configuration. The tips of the brush chains, which constitute the magnet brush MB, sequentially approach the drum 1 in the order shown in FIGS. 2A through 2C. In FIGS. 2A through 2C, part of the sleeve 4, not shown, facing the drum 1 is just developing the boundary between the non-image area and a black, solid image portion; the omission of a trailing edge occurs in this condition. A toner image is shown at the downstream side in the direction of rotation of the drum 1. One brush chain formed on the sleeve 4 approaches the drum 1. In practice, the drum 1 is rotating clockwise as viewed in FIGS. 2A through 2C. However, the brush chain passes the drum 1 because the surface of the drum 4 moves at a higher speed than the surface of the drum 1, as stated earlier. In FIGS. 2A through 2C, the drum 1 is assumed to be stationary for the simplicity of description.

As shown in FIG. 2A, the brush chain approaching the drum 1 continuously faces the non-image portion until it arrives at the trailing edge A of the image portion to be developed. During this movement, a repulsive force B acts between the negative charges and causes the toner grains 3*a* to move toward the sleeve 4 away from the drum 1 (so-called toner drift). As a result, when the brush chain arrives at the trailing edge A of the image portion, the carrier grain 3*b* adjoining the drum 1 and charged to positive polarity has been exposed to the outside, as shown in FIG. 2B. Stated another way, no toner grains are present on the surface of the carrier grain 3*b* that faces the trailing edge A, i.e., no toner grains are transferred from the sleeve 4 to the drum 1 at the trailing edge A. Further, as shown in FIG. 2C, assume that the brush chain reaches a position slightly inward of the trailing edge A of the image portion. Then, if adhesion acting between the toner grains 3*a* and the drum 1 is weak, the toner grains 3*a* deposited on the drum 1 are electrostatically returned to the carrier particles 3*b*. Consequently, the trailing edge portion of the image portion adjoining the non-image portion is not developed and is therefore lost.

Figure 3A:
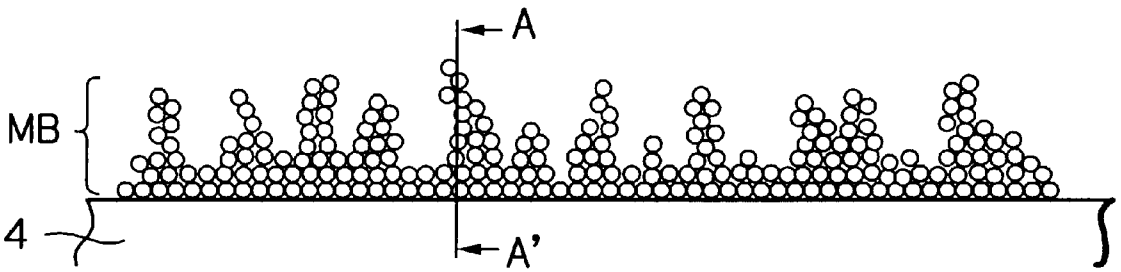
Fig. 3A PRIOR ART
FIG. 3A is a view showing a magnet brush distribution set up by a conventional developing device in a developing region in the axial direction of a sleeve.
Figure 3B:
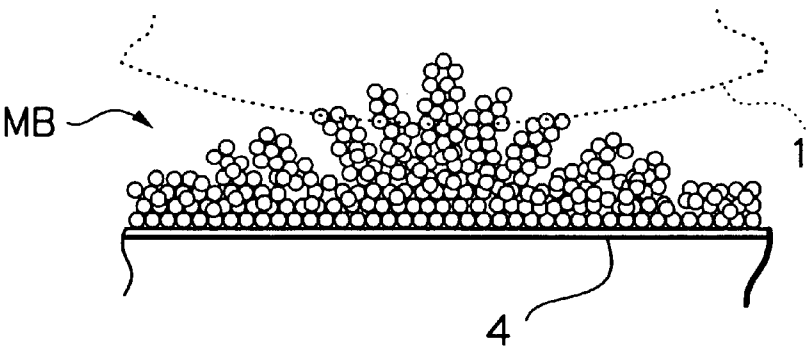
Fig. 3B PRIOR ART
FIG. 3B is a view showing a magnet brush distribution in the direction in which the surface of the sleeve moves.

While the above description has concentrated on a section perpendicular to the axis of the sleeve 4, the brush chains of the magnet brush MB differ in length, or height, as viewed in the axial direction of the sleeve 4. Specifically, FIG. 3A shows the magnet brush MB in the axial direction of the sleeve 4 while FIG. 3B shows it in a section along line A—A of FIG. 3A. FIG. 3B shows the positional relation between the magnet brush MB and the drum 1 in order to indicate the relation between FIG. 3B and the other figures.

Figure 4A:
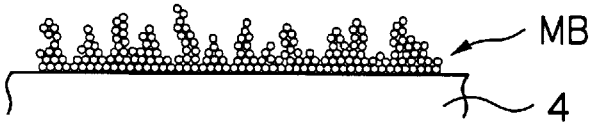
Fig. 4A PRIOR ART
FIG. 4A is a view similar to FIG. 3A.
Figure 4B:
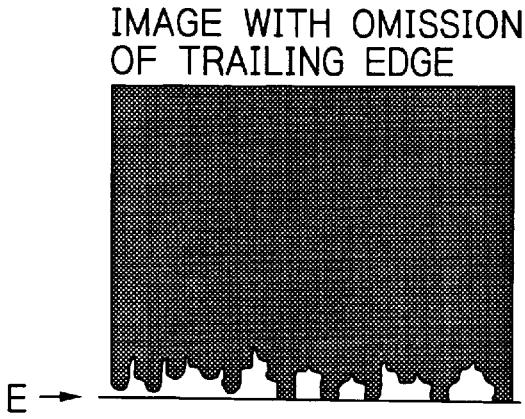
Fig. 4B PRIOR ART
FIG. 4B shows a specific solid image whose trailing edge is lost.

As shown in FIGS. 3A and 4A, the brush chains of the magnet brush MB noticeably differ in height in the axial direction of the sleeve 4 and therefore do not contact the drum 1 at the same level in the above direction. The degree of toner drift therefore differs from one brush chain to another brush chain in the axial direction of the sleeve 4. This brings about the omission of a trailing edge that is jagged in the axial direction of the sleeve 4, as shown in FIG. 4B. Further, the mechanism described above reduces the width of a thin horizontal line, compared to that of a thin vertical line, and makes the shape of a solitary dot unstable.

Figure 5:
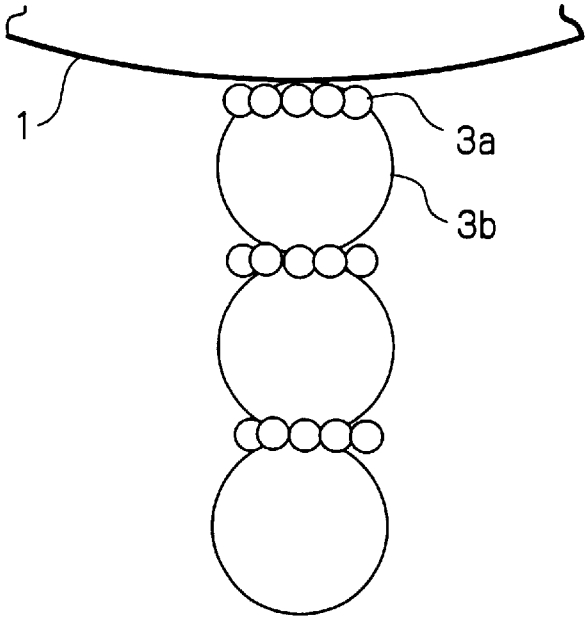
Fig. 5 PRIOR ART
FIG. 5 shows the distribution of magnetic toner grains at the tip of a brush chain.

On the other hand, assume that the developer is implemented by the mixture of magnetic toner and magnetic carrier. Then, a magnetic force acts between the toner and the carrier in addition to the electrostatic attraction described above and tends to move the toner away from the drum, again resulting in the omission of a trailing edge. More specifically, as shown in FIG. 5, at the position where the surface of the drum 1 and the tip of the brush chain contact each other, the magnetic toner grains 3*a* deposit on the magnetic carrier grain 3*b* in the form of a ring. As a result, the exposed surfaced of the carrier grain 3*b* faces the drum 1. This presumably aggravates the omission of a trailing edge ascribable to toner drift. Moreover, the same mechanism further reduces the width of a thin horizontal line, compared to that of a thin vertical line, and makes the shape of a solitary dot unstable.

Figure 6:
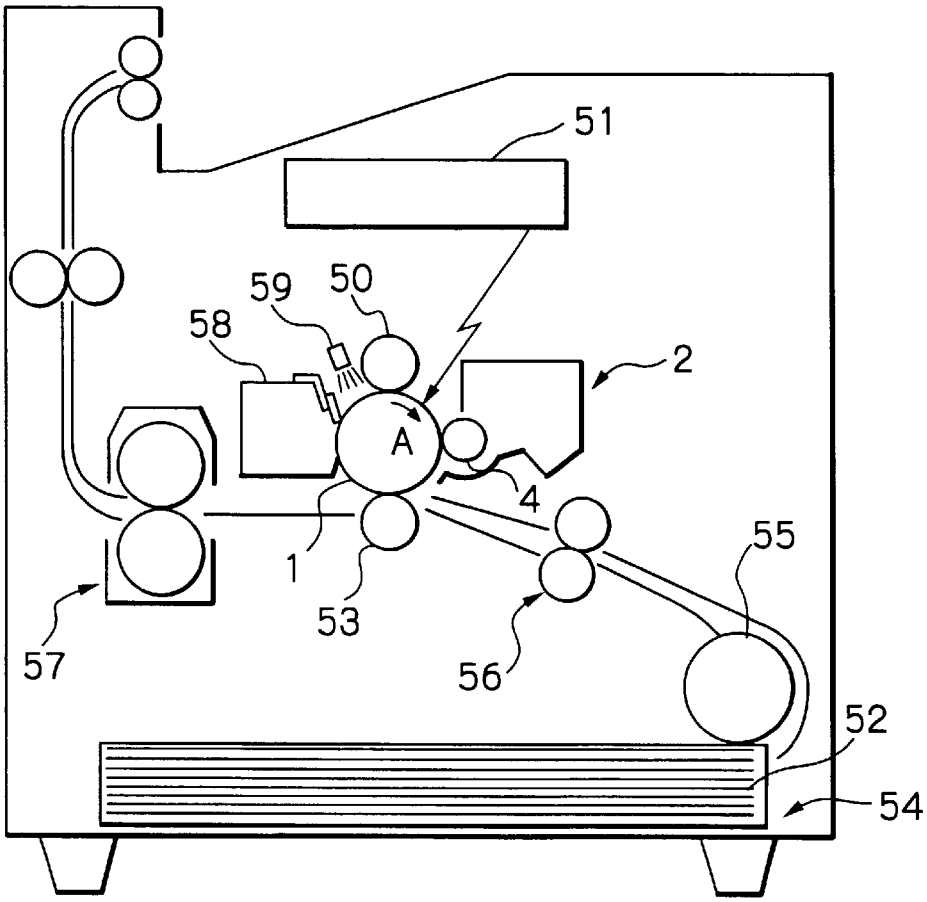
FIG. 6 is a view showing the general construction of an image forming apparatus embodying the present invention.

Referring to FIG. 6, an image forming apparatus embodying the present invention and implemented as a laser printer by way of example will be described. As shown, the laser printer includes a photoconductive drum or image carrier 1 rotatable in a direction A. A charge roller or charger 50 uniformly charges the surface of the drum 1 in contact with the drum 1. An optical writing unit 51 scans the charged surface of the drum 1 in accordance with image data to thereby form a latent image. While the charge roller 50 and optical writing unit 51 constitute latent image forming means, any other charger and any other exposing device may be used.

A developing device 2 develops the latent image with a sleeve 4 to thereby produce a corresponding toner image, as will be described more specifically later. A sheet or recording medium 52 is fed from a sheet cassette 54 to a registration roller pair 56 by a pickup roller 55. The registration roller pair 56 conveys the sheet 52 to an image transfer unit including an image transfer roller 53 at a preselected timing. The image transfer unit transfers the toner image from the drum 1 to the sheet 52. A fixing unit 57 fixes the toner image on the sheet 52. The sheet 52 with the fixed toner image is driven out of the printer. A cleaning device 58 removes the toner left on the drum 1 after the image transfer. Further, a discharge lamp 59 discharges the surface of the drum 1.

Figure 7:
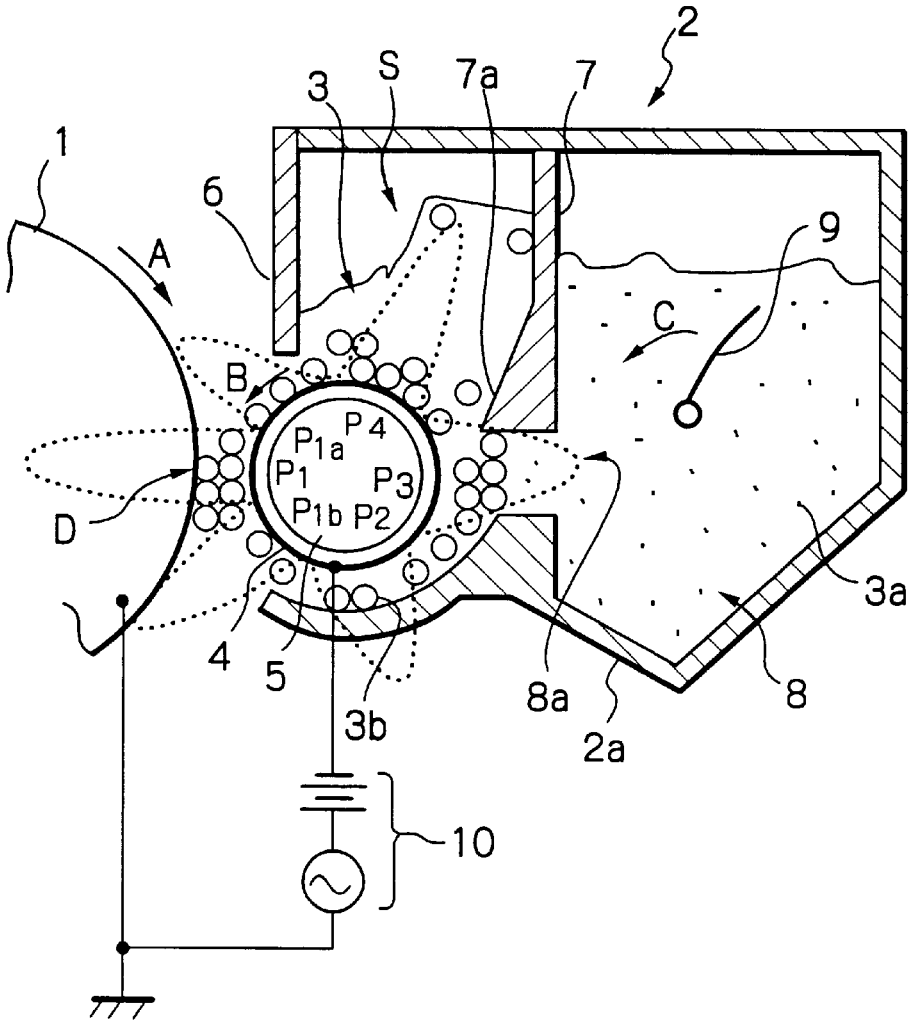
FIG. 7 is a view showing a developing device included in the illustrative embodiment.

FIG. 7 shows the developing device 2 in detail. As shown, a developer made up of magnetic toner grains 3*a* and magnetic carrier grains 3*b* is deposited on the developing sleeve or developer carrier 4, which is nonmagnetic. The sleeve 4 is partly exposed to the outside via an opening formed in a casing 2*a* and facing the drum 1. A drive source, not shown, causes the sleeve 4 to rotate in a direction B for thereby conveying the developer downward (direction B) in a developing region D. The sleeve 4 and drum 1 face each other at the developing region D. A magnet roller or magnetic field forming means 5 is disposed in the sleeve 4 and implemented by a group of stationary magnets.

A doctor or first metering member 6 regulates the amount of the developer being conveyed by the sleeve 4 toward the developing region D. A developer case 7 forms a developer chamber S between the sleeve 4 and the doctor 6 at a position upstream of the doctor 6 in the direction of developer conveyance. A toner hopper 8 stores fresh toner therein. The toner hopper 8 is formed with a port 8*a* adjoining the upstream side of the toner chamber S in the direction of toner conveyance by the sleeve 4. An agitator or agitating member 9 is disposed in the toner hopper 8. The agitator 9 rotates clockwise, as indicated by an arrow C, to thereby convey the fresh toner toward the port 8*a* while agitating it.

The developer case 7 has a penthouse-like edge adjoining the sleeve 4. This edge constitutes a predoctor or second metering member 7*a* for regulating the amount of the toner being replenished into the toner chamber S. Part of the developer obstructed by the doctor 6 is returned to the developer chamber S.

The magnets of the magnet roller 5 form radially outwardly extending magnetic poles positioned one after another around the axis of the roller 5. Specifically, a main pole P1 (N pole) for development causes the developer to rise in the form of brush chains at the position facing the developing region D. Auxiliary poles P1*a* (S pole) and P1*b* (S pole) opposite in polarity to the main pole P1 adjoin the main pole P1 at the upstream side and downstream side, respectively, in the direction of rotation of the sleeve 4. The auxiliary poles P1*a* and P1*b* reduce the angular half-width of a flux density distribution set up by the main pole P1 in the direction normal to the sleeve 4. A pole P4 (N pole) is located between a position facing the predoctor 7*a* and the developing region such that its magnetic field extends to the developer chamber S. Further, a pole P2 (N pole) and a pole P3 (S pole) are so positioned as to convey the developer deposited on the sleeve 4 as in the conventional developing device.

In FIG. 7, dotted curves around the sleeve 4 are representative of flux density distributions formed by the poles in the direction normal to the surface of the sleeve, as measured at the center of the sleeve 4 in the axial direction. While the magnet roller 5 is shown as having six poles, additional poles may be arranged between the auxiliary magnets P1*b* and P1*a*. For example, the magnet roller 5 may have eight or ten poles.

The magnet forming the main pole PI has a small cross-sectional area in a plane perpendicular to the axis of the magnet roller 5. Generally, a magnetic force decreases with a decrease in the cross-sectional area of a magnet. If the magnetic force on the sleeve surface is excessively weak, then it is likely that the force retaining the carrier grains is too weak to prevent the carrier grains from depositing on the drum 1. In light of this, in the illustrative embodiment, the magnet for the main pole P1 is formed of a rare earth metal alloy that exerts a strong magnetic force. Typical of magnets formed of rare earth metal alloys are an iron-neodium-boron alloy magnet having the maximum energy product of about 358 $kJ/m^3$ and an iron-neodium-boron alloy bond magnet having the maximum energy product of about 80 $kJ/m^3$. Such maximum energy products each are greater than, e.g., the maximum energy product of about 36 $kJ/m^3$ available with a conventional ferrite magnet or the maximum energy product of about 20 kJ/m$^3$ available with a conventional ferrite bond magnet. Consequently, even the magnet having a small cross-sectional area can insure the expected magnetic force on the sleeve surface. A samarium-cobalt metal alloy magnet is another magnet that can insure the above magnetic force.

In the illustrative embodiment, during development, a bias power supply or bias applying means 10 applies an AC-biased DC voltage, or oscillating bias voltage, to the sleeve 4 as a bias VB. A background potential VD and an image potential VL lie between the maximum value and the minimum value of the bias VB. The bias VB forms in the developing region D an alternating electric field that varies in direction alternately. The toner grains 3*a* and carrier grains 3*b* actively oscillate in the alternating electric field. As a result, the toner grains 3*a* selectively deposit on the latent image formed on the drum 1, overcoming the electrostatic and magnetic restraints acting on the toner grains 3*a* and carrier grains 3*b*.

The difference between the maximum value and the minimum value of the bias VB (peak-to-peak voltage) should preferably be between 0.5 kV and 5 kV. Also, the frequency of the bias VB should preferably be between 1 kHz and 10 kHz. The bias VB may have any wave shape, e.g., a rectangular, sinusoidal or triangular wave. While the DC component of the bias VB lies between the background potential VD and the image potential VL, it should preferably be closer to VD than to VL in order to avoid fog ascribable to the toner grains 3*a*.

When the bias VB has a rectangular wave, a duty ratio of 50% or less is desirable. Here, a duty ratio refers to the ratio of a period of time during which the toner grains 3*a* tend to move toward the drum 1 to one period of the bias VB. The duty ratio of 50% or less successfully increases a difference between the peak value that cause the toner grains 3*a* to move toward the drum 1 and the time mean of the bias VB. Consequently, the toner grains 3*a* move more actively and faithfully deposit on the potential distribution of the latent image. This not only enhances the developing ability, but also reduces granularity while improving resolution.

Moreover, the duty ratio mentioned above reduces a difference between the peak value that causes the carrier grains 3*b* opposite in polarity to the toner grains 3*a* to move toward the drum 1 and the time mean of the bias VB. This settles the movement of the carrier grains 3*b* and thereby frees the toner grains 3*a* from disturbance at the trailing edge of an image. It follows that the omission of a trailing edge is reduced while the reproducibility of thin lines and solitary dots is enhanced. In addition, the probability that the carrier grains 3*b* deposit on the background is noticeably reduced.

The operation of the developing device 2 will be described with reference to FIG. 7. As shown, rotating in the direction B, the sleeve 4 conveys the developer 3 deposited thereon toward the developing region D. At this instant, the doctor 6 causes the developer to form a thin layer on the sleeve 4. At the developing region D, the toner grains 3*a* are transferred from the sleeve 4 to the latent image formed on the drum 1, developing the latent image. The sleeve 4 further conveys the developer moved away from the developing region D to a position facing the port 8*a* of the toner hopper 8. Fresh, magnetic toner grains 3*a* driven by the agitator 9 are staying in the port 8*a* in such a manner as to contact the developer on the sleeve 4. After the developer has taken in the fresh toner grains 3*a*, the sleeve 4 returns the developer to the developer chamber S. The developer 3 containing such fresh toner grains 3*a* has its internal pressure increased by the doctor 6. In this condition, the toner grains 3*a* and carrier grains 3*b* rub against each other with the result that the toner grains 3*a* are charged by friction. On the other hand, the developer 3 obstructed by the doctor 6 is circulated in the developer chamber S.

Figure 8A:
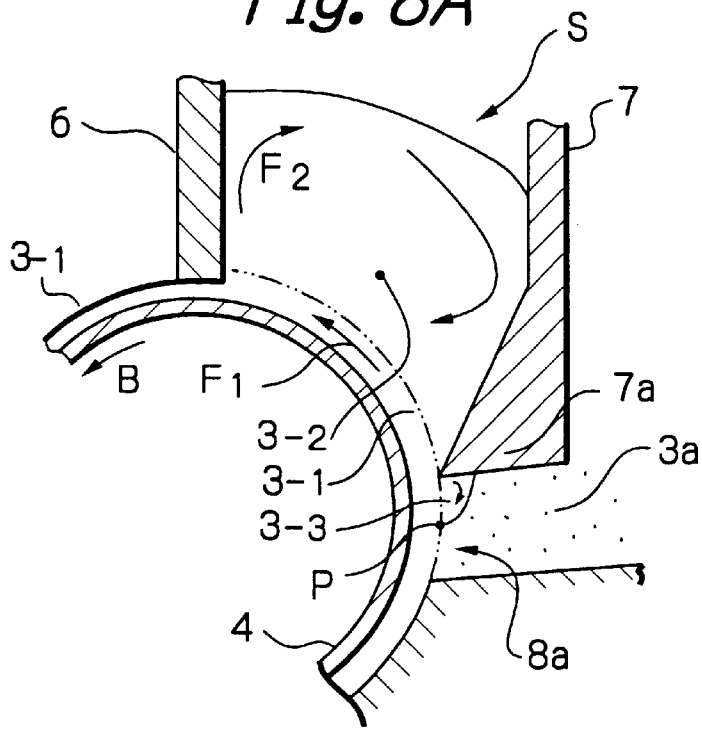
FIGS. 8A and 8B are views demonstrating automatic toner control unique to the illustrative embodiment.
Figure 8B:
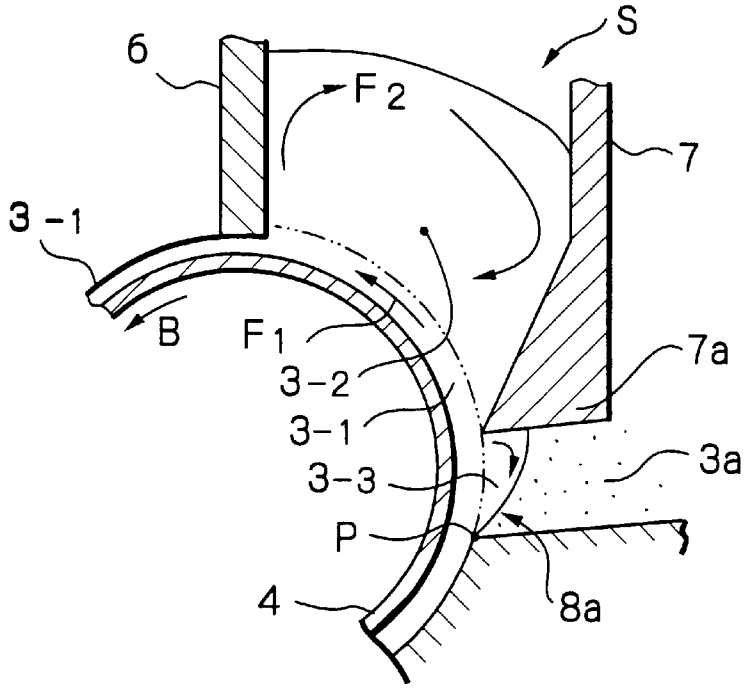

Reference will be made to FIGS. 8A and 8B for describing automatic toner content control unique to the illustrative embodiment. In FIGS. 8A and 8B, a dash-and-dots line indicates a boundary between two parts of the developer that behave in different ways from each other.

Assume that a fresh developer 3 with a preselected toner content and a preselected weight is initially set in the developing device 2. Then, when the sleeve 4 is rotated, the developer 3 parts into a developer 3-1 and a developer 3-2. The developer 3-1 is magnetically deposited on the sleeve 4 and conveyed thereby. The developer 3-2 is held in the developer chamber S and circulated in accordance with the movement of the developer 3-1.

As shown in FIG. 8A, two different flows F1 and F2 occur in the developer chamber S. The first flow F1 is representative of the developer 3-1 moving through a gap between the sleeve 4 and the case 7. The second flow F2 is representative of the developer 3-2 risen upward along the back of the doctor 6 and then circulated in the space between the doctor 6 and the case 7.

Next, assume that fresh magnetic toner 3*a* is set in the toner hopper 8 in the presence of the flows F1 and F2 in the developer chamber S. Then, the toner 3*a* is fed to the developer 3-1 carried on the sleeve 4 via the port 8*a*. The sleeve 4 conveys the developer 3-1 with the toner 3*a* to the developer chamber S. During conveyance, the toner 3*a* contained in the developer 3-1 slightly enters the developer 3-1 toward the axis of the sleeve 4. After the developer 3-1 with the toner 3*a* has moved way from the predoctor 7*a*, it is partly mixed with, or replaced with, the developer 3-2 existing in the developer chamber S. At the same time, the toner 3*a* is uniformly distributed in the entire developer 3 due to agitation. In addition, the toner 3*a* is charged by friction acting between it and the magnetic carrier.

As the toner content of the developer 3 sequentially increases due to the replenishment of the toner 3*a*, the volume of the developer 3-1 increases. Consequently, the thickness of the developer 3-1 forming a layer on the sleeve 4 sequentially increases from the position facing the port 8*a* toward the doctor 6. At the same time, the ratio of the carrier to the developer 3-1 and therefore the magnetic force acting on the developer 3-1 decreases. Consequently, the moving speed of the developer 3-1 decreases, so that the thickness of the developer 3-1 further increases between the position facing the port 8*a* and the doctor 6. The developer 3-1 with such thickness is strongly subjected to the braking force of the doctor 6 and therefore further lowered in moving speed.

The predoctor 7*a* shaves off the upper portion of the developer 3-1 thickened at the position facing the port 8*a*. As shown in FIG. 8A, the portion of the developer 3-1 so shaved off sequentially accumulates at a position upstream of the predoctor 7*a* in the direction of conveyance. Let this part of the developer be referred to as a staying developer 3—3 hereinafter. The staying developer 3—3 is circulated in accordance with the movement of the developer 3-1 contacting it. The toner 3*a* reached the port 8*a* is attracted by the exposed portion of the developer 3-1 and, at the same time, introduced into the developer 3-1 via a point P where the developer 3-1 and staying developer 3—3 join each other.

As shown in FIG. 8B, when the toner content of the developer 3 further increases, the staying developer 3—3 increases in amount and covers the exposed surface of the developer 3-1 contacting the toner 3*a*. At the same time, the point P is shifted to the upstream end of the port 8*a* in the direction of conveyance while the circulation speed of the staying developer 3—3 itself is lowered in the port 8*a*. At this time, the developer 3 substantially ends taking in the toner 3*a* and does not increase in toner content any further.

Part (upper portion) of the developer 3-1 with the toner 3*a* and moved away from the gap between the predoctor 7*a* and the sleeve 7 is mixed with the developer 3-2. The above part of the developer 3-1 is partly again deposited on the sleeve 4. The developer 3-1 moved away from the gap between the sleeve 4 and the doctor 6 is conveyed to the developing region D where the sleeve 4 faces the drum 1. At the developing region D, the toner 3*a* is fed to the latent image formed on the drum 1 to thereby develop the latent image, as stated earlier.

When the toner on the sleeve 4 is consumed by the development, the portion of the developer released the toner decreases in toner content and is strongly subjected to the conveying force of the sleeve 4 while decreasing in volume. Further, the thickness of the developer 3-1 being regulated by the edge of the predoctor 7*a* decreases, causing the circulation speed of the staying developer 3—3 to increase. As a result, the developer 3-1 being conveyed by the sleeve 4 again contacts the toner 3*a* present in the port 8*a* and takes it in to thereby increase its toner content.

As stated above, the condition in which the predoctor 7*a* regulates the developer 3-1 carried on the sleeve 4 varies in accordance with the toner content of the developer 3-1. Consequently, the toner content of the developer released the toner for development is automatically controlled to a preselected range. This successfully maintains the toner content of the developer 3-1 substantially constant without resorting to a sophisticated, toner content control mechanism including a toner content sensor and a toner replenishing member.

If desired, a peeling member for peeling off part of the developer 3-1 carried on the sleeve 4 and mixing it with the developer 3-2 may be disposed in the developer chamber S such that it faces the sleeve 4. The peeling member will promote the replacement of the developers 3-1 and 3-2 and will thereby prevent the deterioration of the developer 3 from being accelerated due to the fall of the chargeability of the carrier contained in the developer 3. Further, the mixture of the developers 3-1 and 3-2 sets up a uniform toner content in the widthwise direction of an image perpendicular to the direction of conveyance.

The developer applicable to the illustrative embodiment will be described hereinafter. The illustrative embodiment uses automatic toner content control that causes toner content to vary over a relatively broad range, as stated above. In this respect, to avoid toner scattering when the toner content becomes high, it is desirable to use magnetic toner having the following property.

The magnetic toner should preferably have a weight mean grain size ranging from 4 μm to 15 μm. The weight mean grain size of toner is measured by the following procedure. First, 0.1 ml to 5 ml of surfactant, preferably alkylbenzene sulfonate, is added to 100 ml to 150 ml of an electrolytic aqueous solution as a dispersant. For the electrolyte, use is made of an about 1% NaCl aqueous solution prepared by use of primary sodium chloride, e.g., ISOTON-II (trade name) available from Coulter. Subsequently, 2 mg to 20 mg of a sample to be measured is added to the aqueous solution. The electrolyte with the sample is then dispersed for about 1 minute to 3 minutes by an ultrasonic dispersing machine. Subsequently, an analyzer E-SPART ANALYZER available from HOSOKAWA MICRON CORP. is used to measure the volume and the number of toner grains with an aperture of 100 μm, thereby determining a volume distribution and a number distribution. Such distributions derive the mean weight grain size (D4) and number mean grain size of the toner. For the measurement, thirteen channels are used, i.e., a range between 2.00 μm and less than 2.52 μm, a range between 2.52 μm and less than 3.17 μm, a range between 3.17 μm and less than 4.00 μm, a range between 4.00 μm and less than 5.04 μm, a range between 5.04 μm and less than 6.35 μm, a range between 6.35 μm and less than 8.00 μm, a range between 8.00 μm and less than 10.08 μm, a range between 10.08 μm and less than 12.70 μm, a range between 12.70 μm and less than 16.00 μm, a range between 16.00 μm and less than 20.20 μm, a range between 20.20 μm and less than 25.40 μm, a range between 25.40 μm and less than 32.00 μm, and a range between 30.00 μm and less than 40.40 μm.

The toner is made up of 75% to 93% of binding resin, 3% to 10% of coloring agent, 3% to 8% of parting agent, and 1% to 7% of other components. For the binding resin, use may be made of any one of polystyrene, poly-p-chlorostyrene, polyvinyl toluene or similar styrene or a polymer of its substitution product, styrene-p-chlorostyrene copolymer, styrene-vinyltoluene copolymer, styrene-vinylnaphthalene copolymer, styrene-acrylic ester copolymer, styrene-methacrylic ester copolymer, styrene-α-chloromethacylic methyl copolymer, styrene-acrylonitrile copolymer, styrene-vinylmethyl ether copolymer, styrene-vinylethyl ether copolymer, styrene-vinylmethyl ether copolymer, and styrene-vinylmethyl ketone.

The coloring agent may be implemented by any one of conventional organic or inorganic dyes and pigments, e.g., carbon black, Aniline Black, Acetylene Black, Naphthol Yellow, Hansa Yellow, Rhodamine Lake, Arizarine Lake, Indian red, Phtalocyanine Blue, and Indus Blue.

The binding resin contains a magnetic material selected from a group of iron oxides including magnetite, γ-iron oxides, ferrite iron and excess type ferrite, a group of magnetic metals including iron, cobalt and nickel, and a composite metal oxide compound alloy of iron oxide or magnetic metal and cobalt, tin, titanium, copper, lead, zinc, magnesium, manganese, aluminum, silicon or similar metal or a mixture thereof. The magnetic grains should preferably have a mean grain size of 0.05 μm to 1.0 μm, more preferably 0.1 μm to 0.6 μm or even more preferably 0.1 μm to 0.4 μm. Also, the magnetic grains should preferably have a surface area of 1 $m^2/g$ to 20 $m^2/g$, particularly 2.5 $m^2/g$ to 12 $m^2/g$, as measured by the BET (Brunauer-Emmett-Teller) nitrogen adsorption method, and have Moths hardness of 5 to 7.

While the magnetic grains may have an octagonal, hexagonal, spherical, needle-like or scale-like shape, an octagonal, hexagonal or spherical shape with little anisotropy is desirable. The toner should preferably contain about 10 parts by mass to 150 parts by mass, more preferably 20 parts by mass to 120 parts by mass, of magnetic grains to 100 parts by mass of binding agent.

In the illustrative embodiment, additives may be added to the toner in an amount small enough to avoid adverse influence. The additives include Teflon powder, stearic zinc powder, vinylidene polyfluoride powder or similar lubricant powder, cerium oxide powder, silicon carbonate powder, titanic strontium powder or similar abrasive, titanium oxide powder, aluminum oxide powder or similar fluidity agent or anti-caking agent, carbon black powder, zinc oxide powder, tin oxide powder or similar conductivity agent, and organic or inorganic grains of opposite polarity.

As for parting agent that may be used to improve fixation, there may be used paraffin wax or derivative thereof, microcrystalline wax or derivative thereof, Fischer Tropsch wax or derivative thereof, polyolefin wax or derivative thereof, or carnauba wax or derivative thereof. The derivatives include oxides, block copolymers with vinyl monomers, and graft modulations of vinyl monomers. Other possible derivatives include alcohol, fatty acid, acid amide, ester, ketone, hardened castol oil, and derivatives thereof, and plant wax, and mineral wax.

The toner may further contain a charge control agent. A charge control agent that charges the toner to negative polarity may advantageously be implemented by any one of organic metal complexes and chelate compounds, e.g., mono/azo metal complexes, acetylacetone metal complexes, aromatic hydroxycarboxylic acid metal complexes, and aromatic dicarboxilic acid metal complexes. Other possible charge control agents of this kind are aromatic hydroxicarboxylic acid, aromatic mono/polycarboxylic acid or metal salt, anhydride or ester thereof, and bisphenol and other phenol derivatives.

A charge control agent that charges the toner to positive polarity may be any one of substances modulated by Nigrosine and fatty acid metal salts, tributhylbenzyleammonium-1-hydroxy-4-naphthosulphonate, tetrabuthylammonium tetrafluoroborate or similar quaternary ammonium salt, phosnium salt or similar onium salt analogous thereto or lake pigment thereof, and triphenyl methane dye or lake pigment thereof. A lake agent may be any one of phosphoric tungstic acid, phosphoric molibdic acid, phosphoric tungsten-molybdic acid, tannic acid, lauric acid, gallic acid, ferricyanic compound, and ferrocyanic compound. The charge control agent in the form of grains should preferably have a grain size of 4 $\mu$m or less, more preferably 3 $\mu$m or less. When such a charge control agent is contained in the toner grains, the toner grains should preferably contain 0.1 parts by mass to 20 parts by mass, more preferably 0.2 parts by mass to 10 parts by mass, of charge control agent to 100 parts by mass of binding resin.

In the illustrative embodiment, the toner may additionally contain any one of conventional additives for toner, e.g., colloidal silica and other fluidity agents, titanium oxide, aluminum oxide and other metal oxides, silicon carbonate and other abrasives, and fatty acid metal salts and other lubricants. Inorganic powder should preferably be used by 0.1% by mass to 2% by mass with respect to the toner. Amounts less than 0.1% by mass would fail to reduce toner cohesion as expected. Amounts greater than 2% by mass would cause the toner to be scattered between thin lines, to smear the interior of the apparatus or to scratch or wear the photoconductive element.

The additives stated above may be mixed with the toner by any conventional scheme, e.g., by a Henchel mixer or a speed kneader. After kneading and cooling, toner powder may be produced by any conventional method, e.g., one that pulverizes the toner with a jet mill and then sieves it.

As for a dry, toner and carrier mixture, the magnetic carrier and toner should preferably be mixed such that the toner grains deposit on each carrier grain over 30% to 100% of the surface area of the carrier grain.

The core of the individual carrier grain may be formed of any conventional material, e.g., iron, cobalt, nickel or similar ferromagnetic metal, magnetite, hematite, ferrite or similar alloy or compound, or a combination of the ferromagnetic metal and resin.

The carrier grains should preferably be coated with resin for enhancing durability. The resin may be any one of polyolefine resins including polyethylene, polypropylene, chlorinated polyethylene and chlorosulfonated polyethylene, polyvinyl and polyvinylidene resins including polystyrene, acryl (e.g. poly(methyl methacrylate)), plyacrylonitrile, polyvinyl acetate, polyvinyl alcohol, polyvinyl butyral, polyvinyl chloride, polyvinyl carbazole, polyvinyl ether and polyvinyl ketone, vinyl chloride-vinyl acetate copolymer, silicone resin with organosiloxane bond or modified form thereof (using, e.g. alkyd resin, polyester resin, epoxy resin or polyurethane), fluorocarbon resins including polytetrafluoroehtylene, polyvinyl fluoride, polyvinylidene fluoride, polychlorotrifuluoroethylene, polyamide, polyester, polyurethane, polycarbonate, amino resins including urea-formardehyde resin, and epoxy resins. Among them, silicone resin or modified form thereof and fluorocarbon resin, particularly silicon resin or modified form thereof, is desirable to avoid toner spent.

To form the coating layer, a liquid for forming the layer may be applied to the surfaces of the carrier cores by, e.g., spraying or immersion as conventional. The coating layer should preferably be 0.1 $\mu$m to 2 $\mu$m thick.

A more specific procedure used to produce the toner and carrier mixture of the illustrative embodiment will be described hereinafter. As for the magnetic toner, the following mixture was prepared:

- 100 parts by mass of polyester resin (weight mean grain size of 300 $\mu$m and softening temperature of 80.2° C.)
- 10 parts by mass of carbon black
- 60 parts by mass of magnetite
- 5 parts by mass of polypropylene (weight mean particle size of 180 $\mu$m)
- 2 parts by mass of quaternary ammonium salt The above mixture was melted, kneaded, pulverized and then sieved. Subsequently, 0.3 parts by mass of hydrophobic silica was mixed with 100 parts by mass of the colored particles, thereby producing toner whose mean grain size was 9.0 $\mu$m.

As for the magnetic carrier, 2 parts by mass of polyvinyl alcohol and 60 parts by mass of water were mixed with 100 parts by mass of magnetite, which was prepared by a wet process, in a ball mill for 12 hours to thereby produce a magnetite slurry. The slurry was sprayed by a spray dryer to form grains. The grains were sintered at 1,000° C. for 3 hours in a nitrogen atmosphere and then cooled off to form cores. Subsequently, 100 parts by mass of silicone resin solution, 100 parts by mass of toluene, 15 parts by mass of γ-aminopropyl trimetoxysilane and 20 parts by mass of carbon black were dispersed together in a mixer for 20 minutes to thereby prepare a coating liquid. The surfaces of 100 parts by mass of the core grains were coated with the coating liquid by use of a fluidized bed type of coating device, thereby producing magnetic carrier grains coated with silicon resin.

Finally, 10 parts by mass of the magnetic toner grains were mixed with 90 parts by mass of the magnetic carrier grains to thereby complete a two-ingredient type developer.

Figure 9:
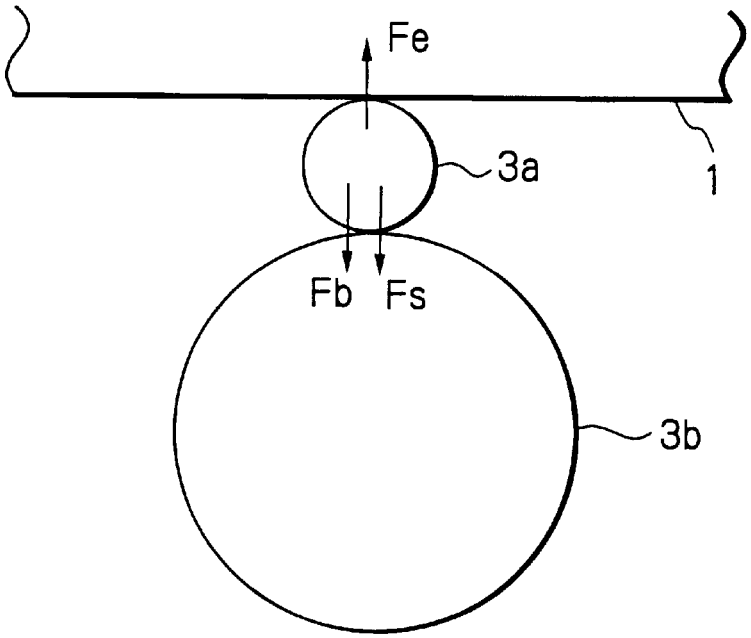
FIG. 9 show forces acting on a toner grain at the tip of a magnet brush.

FIG. 9 shows forces acting between the drum 1, the toner grain 3*a* and the carrier grain 3*b*. As shown, a force Fe derived from the electric field acts on the toner grain 3*a* between the toner grain 3*a* and the drum 1, as indicated by an arrow. Also, an electrostatic force Fs acts between the toner grain 3*a* and the carrier grain 3*b*, as indicated by an arrow. In addition, A magnetic force Fb attracting the toner grain 3*a* toward the sleeve 4 acts on the toner grain 3*a*, as indicated by an arrow. The force derived from toner drift stated earlier may be considered to be the increment (α) of the electrostatic force Fs. More specifically, when toner drift occurs, the sum of Fs and α acts on the toner grain 3*a* and tends to return it toward the carrier grain 3*b*. The magnetic force Fb is absent in the case of nonmagnetic toner. The magnetic force Fb therefore makes the magnetic toner inferior to nonmagnetic toner as to the reproducibility of the trailing edge of a solid image or that of a halftone image, thin lines, and solitary dots.

Figure 10A:
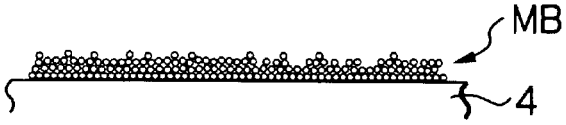
FIG. 10A shows a magnet brush distribution in a developing region in the axial direction of a sleeve.
Figure 10B:
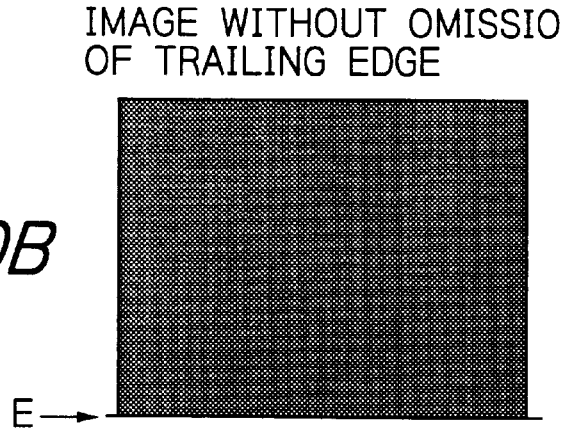
FIG. 10B shows a specific solid image achievable with the illustrative embodiment.

In light of the above, in the illustrative embodiment, the flux density set up by the main pole P1 in the direction normal to the surface of the sleeve 4 is provided with a peak value whose attenuation ratio is 50% or above. This reduces the nip width for development, i.e., the width of the developing region D in the direction of movement of the sleeve surface. Such a nip width successfully reduces the increment a of the electrostatic force Fs to zero or reduces it to a noticeable degree, as determined by experiments. In addition, the developer forms a dense magnet brush in the developing region D. Moreover, as shown in FIG. 10A, it was experimentally found that the magnet brush had a uniform height over the entire axial direction of the sleeve 4. FIG. 10B shows the resulting solid image without its trailing edge being omitted. Image quality can therefore be improved despite the use of the magnetic toner. In FIG. 10B, the trailing edge of the image is indicated by letter E.

Figure 11A:
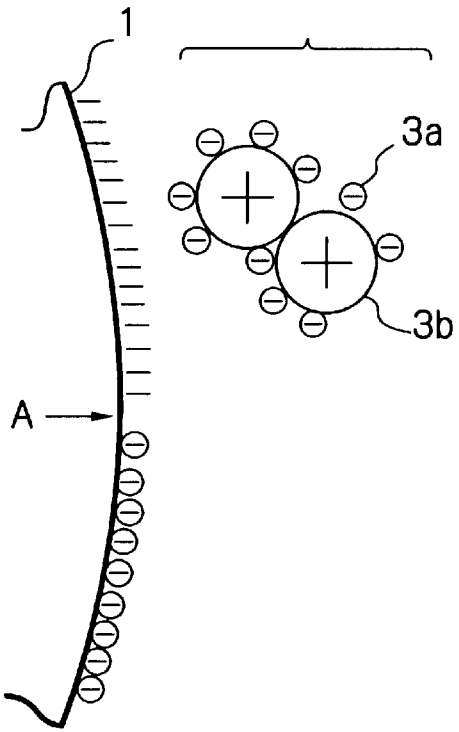
FIGS. 11A through 11C are views demonstrating how the illustrative embodiment reduces the omission of a trailing edge.
Figure 11B:
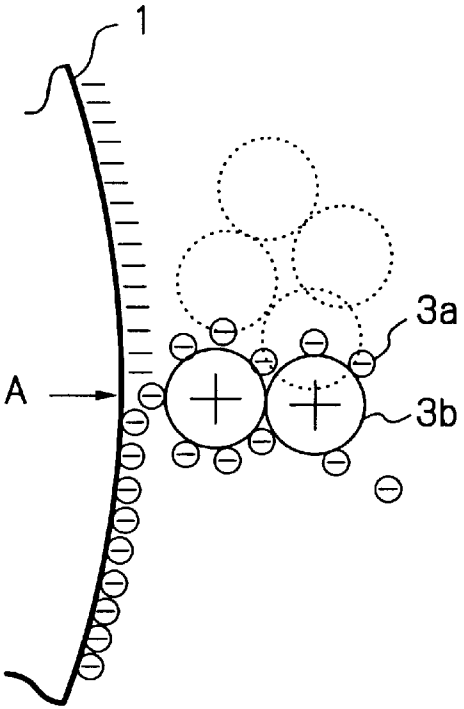
Figure 11C:
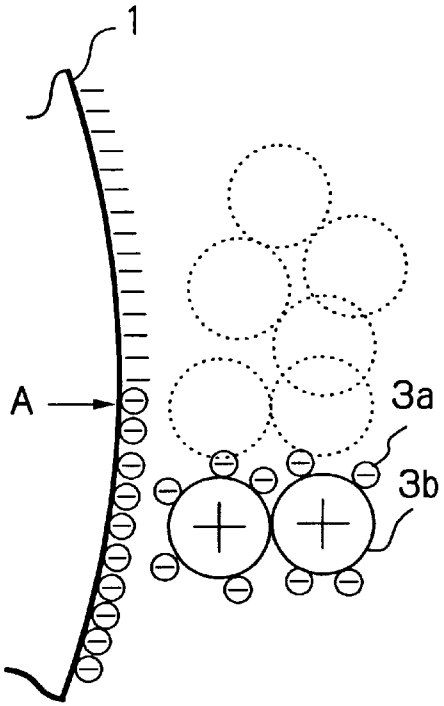

How the illustrative embodiment improves image quality will be described more specifically with reference to FIGS. 11A through 11C. As shown in FIG. 11A, the magnet brush of the illustrative embodiment contacts the drum 1 only for a short period of time, thereby reducing toner drift, i.e., the movement of the toner grains 3*a* toward the sleeve 4. Therefore, as shown in FIG. 11B, the toner grains 3*a* are present even at the position A where the magnet brush fases the trailing edge of an image, covering the surfaces of the carrier grains 3*b*. This prevents toner grains once deposited on the drum 1 from again depositing on the carrier grains 3*b* forming the tip of the magnet brush. In this manner, the illustrative embodiment reduces defective images.

Figure 12A:
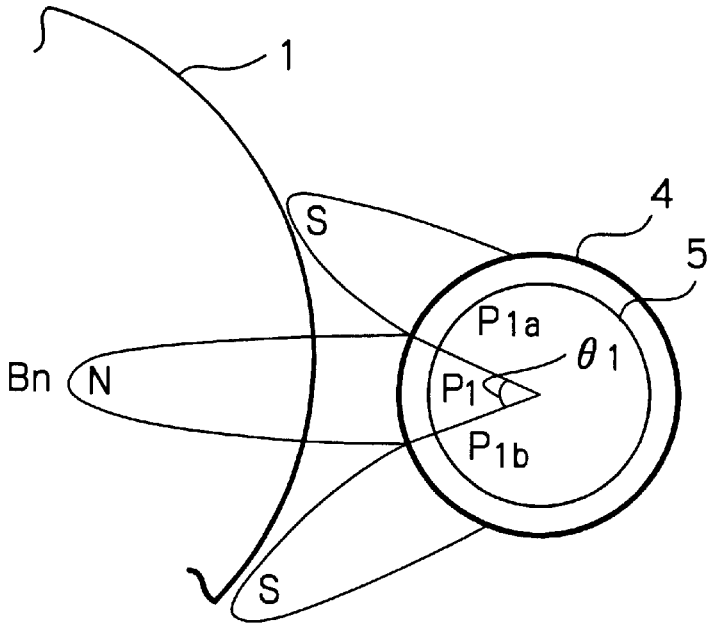
FIG. 12A is a view for describing the angular width of a flux density between 0 mT polarity transition points that is set up by a main pole in the normal direction.
Figure 12B:
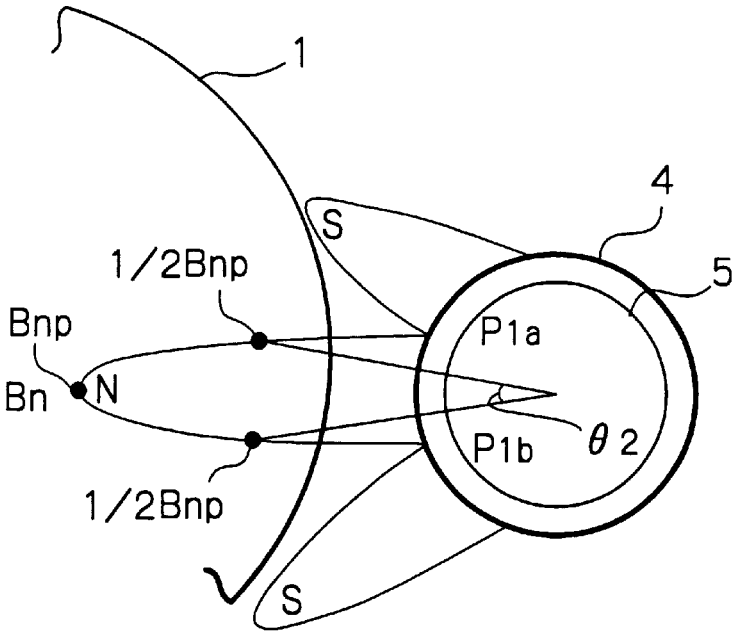
FIG. 12B is a view for describing the angular half-width of the flux density in the direction in which the sleeve surface moves.

FIGS. 12A and 12B each show another specific factor that may be defined in place of the attenuation ratio of the flux density in the normal direction. Specifically, FIG. 12A shows an angular width θ1 between the 0 mT polarity transition points of flux density Bn in the direction normal to the surface of the sleeve 4. The 0 mT polarity transition points refer to points where the flux density becomes 0 mT as the distance from the center of the main pole P1 increases, i.e., where the direction of the flux density reverses. FIG. 12B shows the angular half-width θ2 of the flux density Bn in the direction in which the sleeve surface moves. By defining the angular width θ1 or the half-width θ2, it is also possible to obviate defective images. Specifically, the angle θ1 of 140° or less or the angle θ2 of 20° or less is selected.

Specific examples of the illustrative embodiment will be described hereinafter.

EXAMPLE 1

Example 1 was conducted under conditions listed in FIG. 13. To measure flux density, use was made of a gauss meter HGM-8300 available from ADS and an axial probe Type A1 also available from ADS. A circle chart recorder was used to record measured flux density. This is also true with the other examples to be described later.

The attenuation ratio (%) of the peak value of the flux density Bn set up by the main pole P1 in the normal direction was varied to measure the amount of omission of the trailing edge of a solid image and the horizontal-to-vertical line ratio. The amounts of omission lying in the range of from 0 mm to 0.4 mm were determined to be acceptable. As for the horizontal-to-vertical line ratio, assume that a horizontal line and a vertical line having the same width on a document are reproduced. Then, the above ratio refers to a value produced by dividing the width of the reproduced vertical line (parallel to the direction of movement of the sleeve surface) by the width of the reproduced horizontal line (perpendicular to the direction of movement of the sleeve surface). A greater ratio means a greater degree of thinning of the horizontal line.

Figure 14:
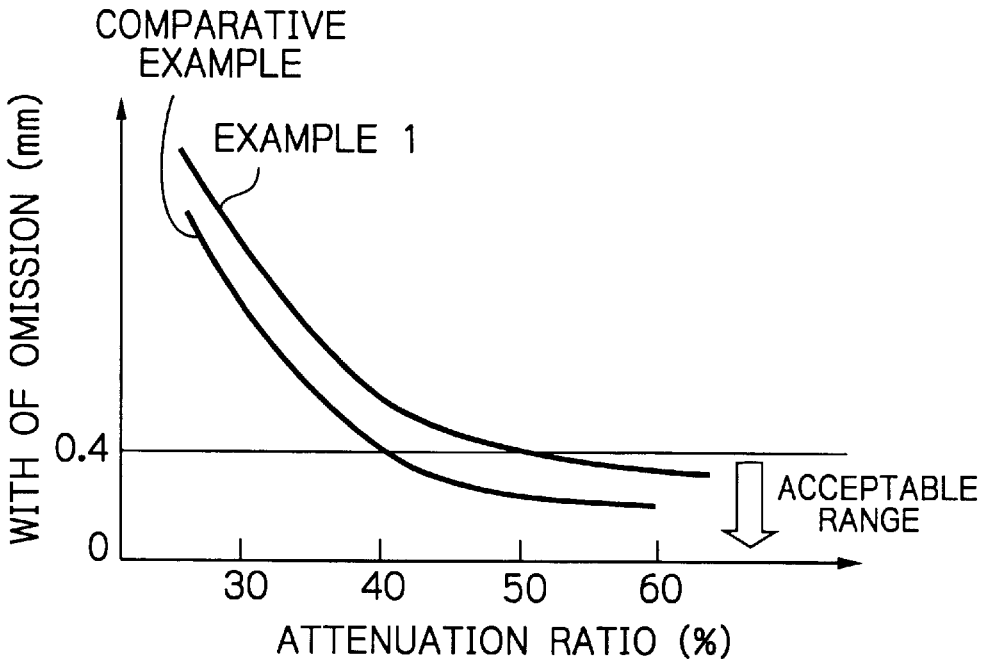
FIG. 14 is a graph showing a relation between the attenuation ratio of a flux density in the normal direction and the width of the omission of a trailing edge as determined by Example 1.
Figure 15:
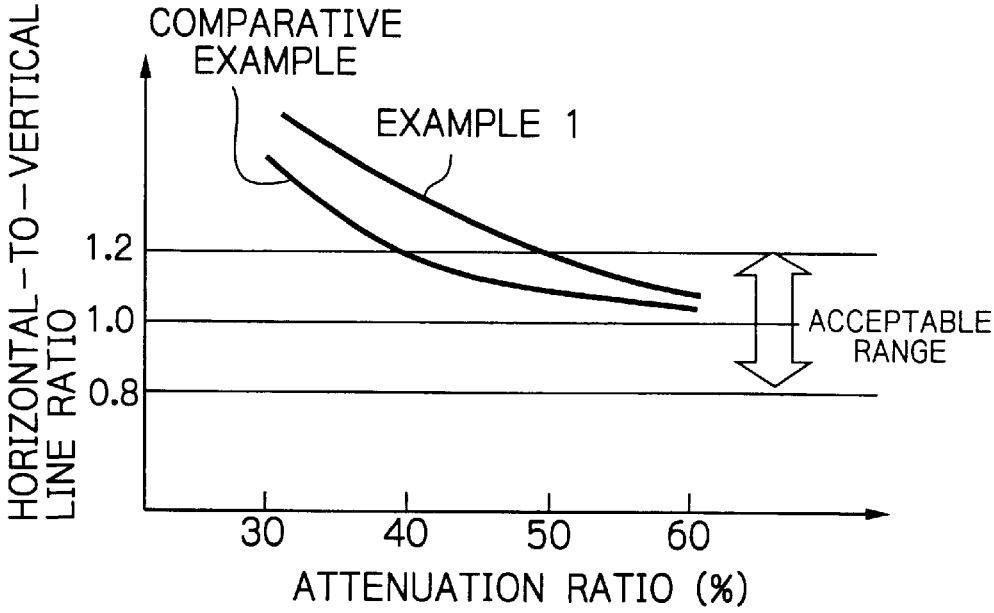
FIG. 15 is a graph showing a relation between the attenuation ratio of the flux density and the horizontal-to-vertical line ratio as also determined by Example 1.

FIGS. 14 and 15 show the results of experiments conducted with Example 1 together with data determined with nonmagnetic toner for comparison. As shown, as for the magnetic toner, there can be reduced the degree of the omission of a trailing edge and that of the thinning of a horizontal line if the peak value of the flux density Bn is provided with the attenuation ratio of 50% or above.

EXAMPLE 2

Figure 16:
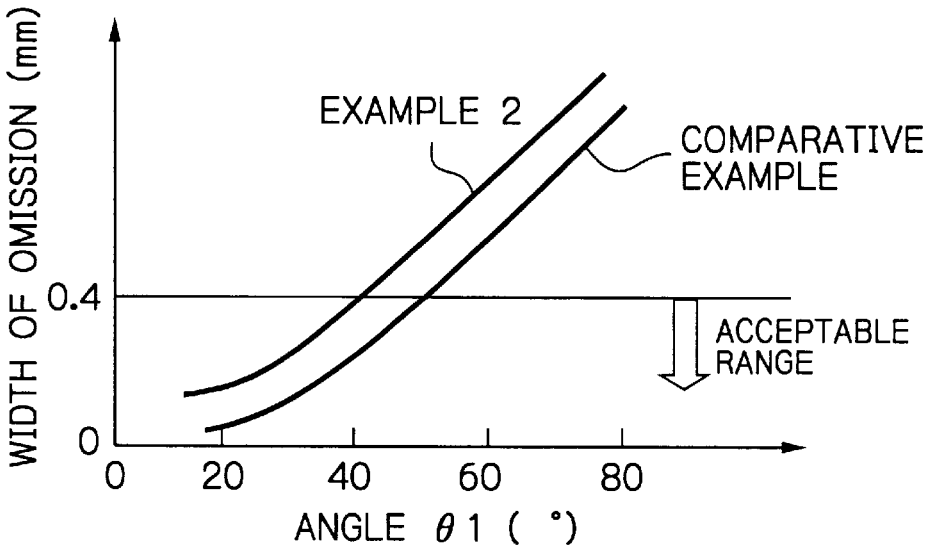
FIG. 16 is a graph showing a relation between the angular width of a flux density between 0 mT polarity transition points in the normal direction and the width of the omission of a trailing edge as determined by Example 2.
Figure 17:
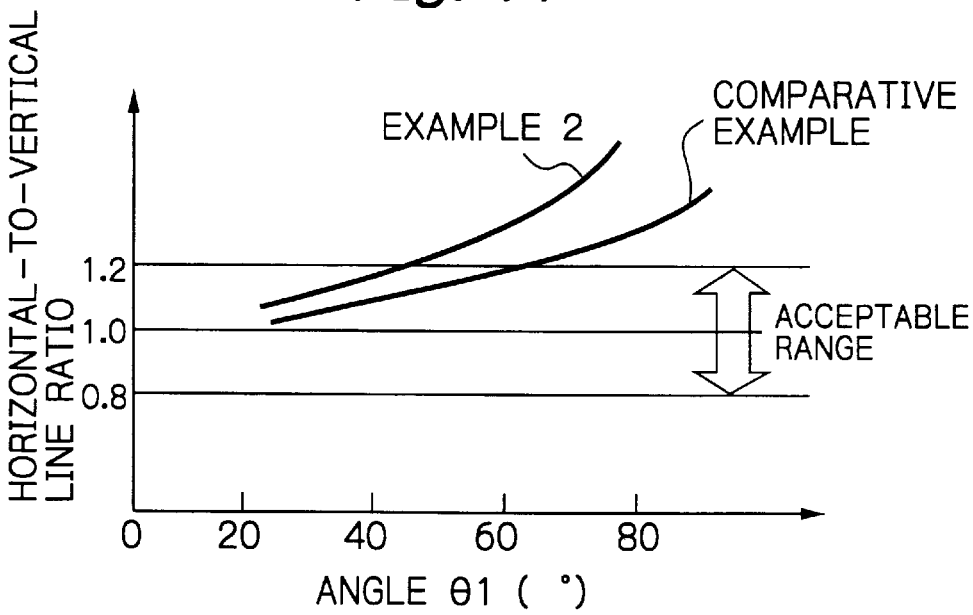
FIG. 17 is a graph showing a relation between the angular width of the flux density and the horizontal-to-vertical line ratio as also determined by Example 2.

Example 2 pertains to a relation between the angle θ1 between the 0 mT polarity transition points and the amount of omission of the leading edge of a solid image and horizontal-to-vertical line ratio. FIGS. 16 and 17 show experimental results relating to Example 2. As shown, as for the magnetic toner, there can be reduced the degree of the omission of a trailing edge and that of the thinning of a horizontal line if the angle θ1 is 40% or less.

EXAMPLE 3

Figure 18:
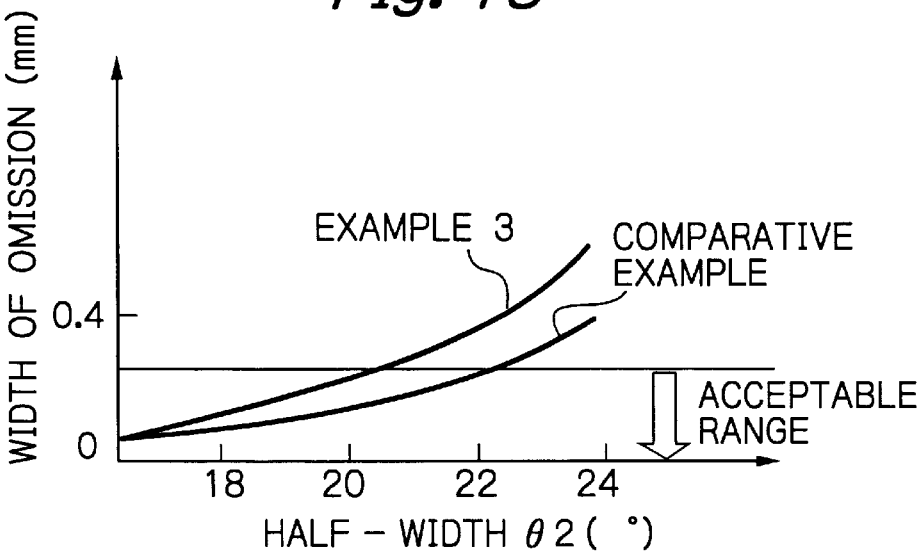
FIG. 18 is a graph showing a relation between the angular half-width of the flux density in the normal direction and the width of the omission of a trailing edge as determined by Example 3.
Figure 19:
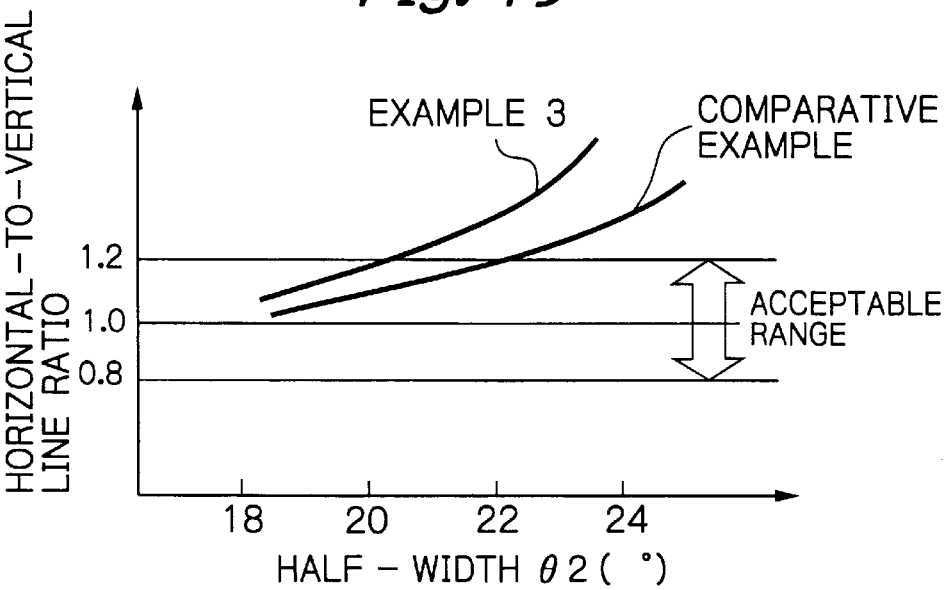
FIG. 19 is a graph showing a relation between the angular half-width of the flux density in the normal direction and the horizontal-to-vertical line ratio as also determined by Example 3.

Example 3 pertains to a relation between the half-value θ2 and the amount of omission of the leading edge of a solid image and horizontal-to-vertical line ratio. FIGS. 18 and 19 show experimental results relating to Example 3. As shown, as for the magnetic toner, there can be reduced the degree of the omission of a trailing edge and that of the thinning of a horizontal line if the halve-value θ2 is 20% or less.

EXAMPLE 4

Example 4 pertains to a relation between the toner content of the developer and the scattering of toner, background contamination, carrier deposition on the drum 1 and developing ability (Yvalue). As for the developing ability, image density ID for a developing potential of 1 kV was measured; a target value was 2.3 ID/kV and above. As FIG. 20 indicates, when toner content is between 4% by mass and 20% by mass, there can be reduced all of the toner scattering, background contamination and carrier deposition, and there can be improved the developing ability.

EXAMPLE 5

Example 5 pertains to a relation between the magnetic substance content of the toner and the toner scattering and developing ability (Yvalue). As FIG. 21 indicates, desirable results were achieved as to toner scattering and developing ability when the magnetic substance content of the toner was between 10% by mass and 50% by mass with respect to resin. Magnetic substance contents below 10% by mass failed to obviate toner scattering while contents above 50% by mass failed to implement sufficient developing ability.

EXAMPLE 6

Figure 22:
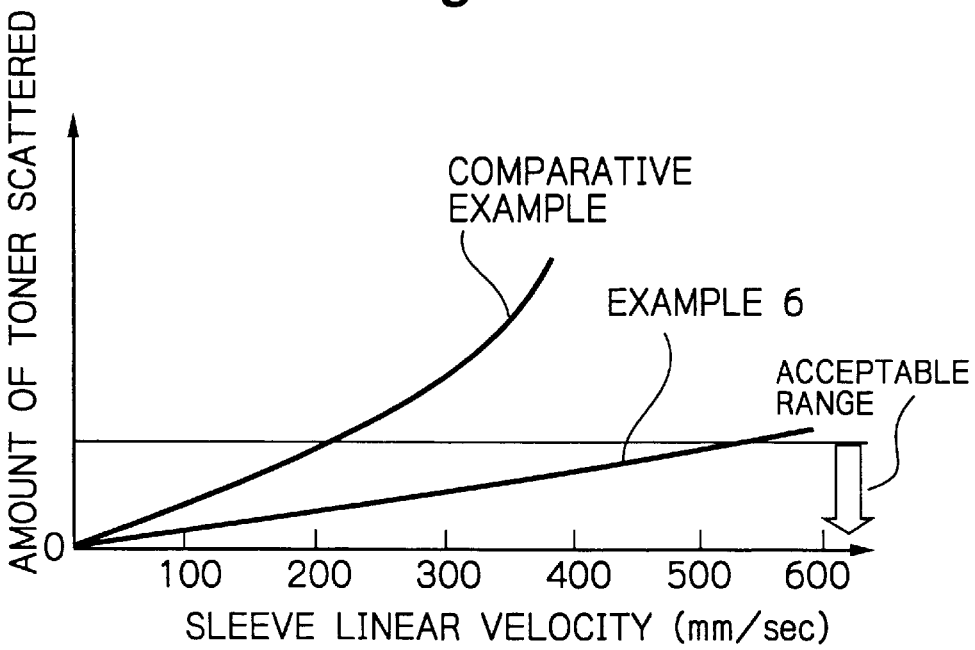
FIG. 22 is a graph showing a relation between the sleeve linear velocity and the amount of toner scattered as determined by Example 6.

Example 6 pertains to a relation between the linear velocity of the sleeve 4 and the toner scattering when the magnetic substance content of the toner is between 10% by mass and 50% by mass. As FIG. 22 indicates, when the linear velocity of the sleeve 4 was 550 mm/sec or below, the toner with the above magnetic substance content was surely prevented from being scattered. By contrast, a comparative example using nonmagnetic toner caused the toner to be noticeably scattered around when the linear velocity exceeded 200 mm/sec.

It is to be noted that an "acceptable range" shown in FIG. 2 has an upper limit at which the toner is scattered only in and around the developing device and accumulates on the developing device, but such is not critical as to practical use. In the acceptable range, the toner is not entrained by an air stream in the developing device or does not fall from the developing device onto other portions or appear in the developed image. Moreover, the toner flows out of the apparatus little although slightly smearing a filter.

EXAMPLE 7

Figure 23:
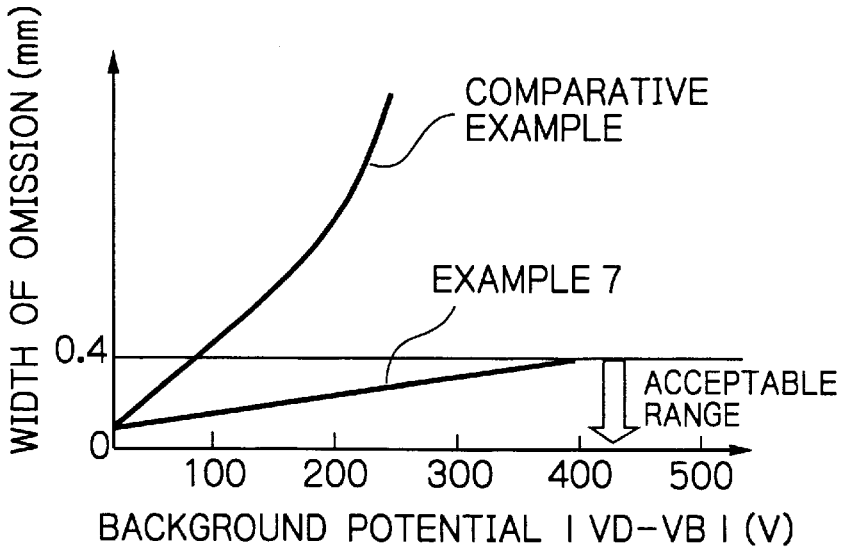
FIG. 23 is a graph showing a relation between the background potential and the width of the omission of a trailing edge as determined by Example 7.
Figure 24:
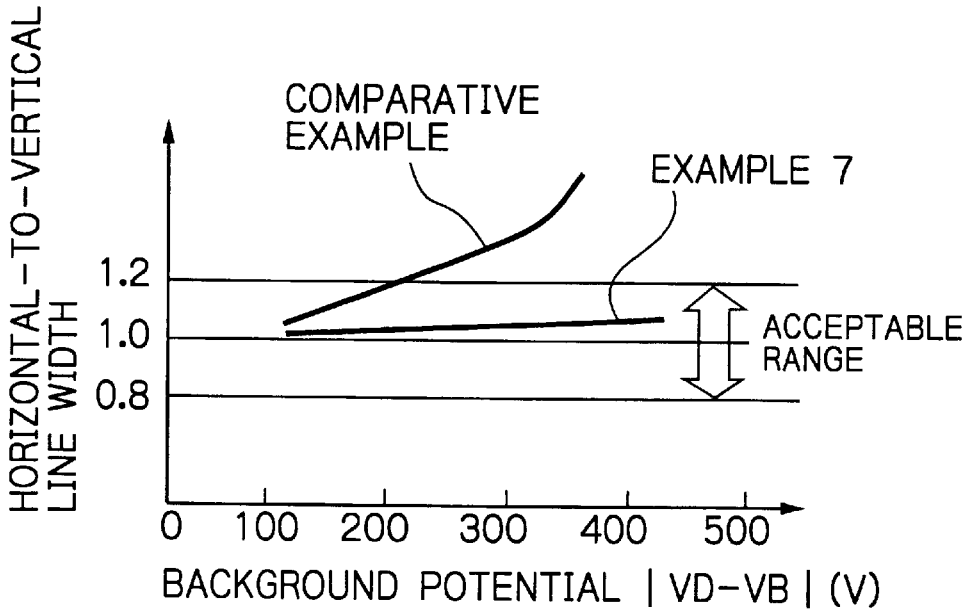
FIG. 24 is a graph showing a relation between the background potential and the horizontal-to-vertical line ratio as also determined by Example 7.

Example 7 pertains to a relation between the background potential, which is the absolute value of a difference between the background potential VD and the bias VB, and the omission of a trailing edge and horizontal-to-vertical line ratio. As FIGS. 23 and 24 indicate, when the background potential was 400 v or below, the omission of a trailing edge and the thinning of a horizontal line were surely reduced to an acceptable range with the magnetic toner. By contrast, as for nonmagnetic toner, the omission of a trailing edge and the thinning of a horizontal line respectively became critical when the background potential exceeded 100 V and when it exceeded 200 V.

EXAMPLE 8

Figure 25:
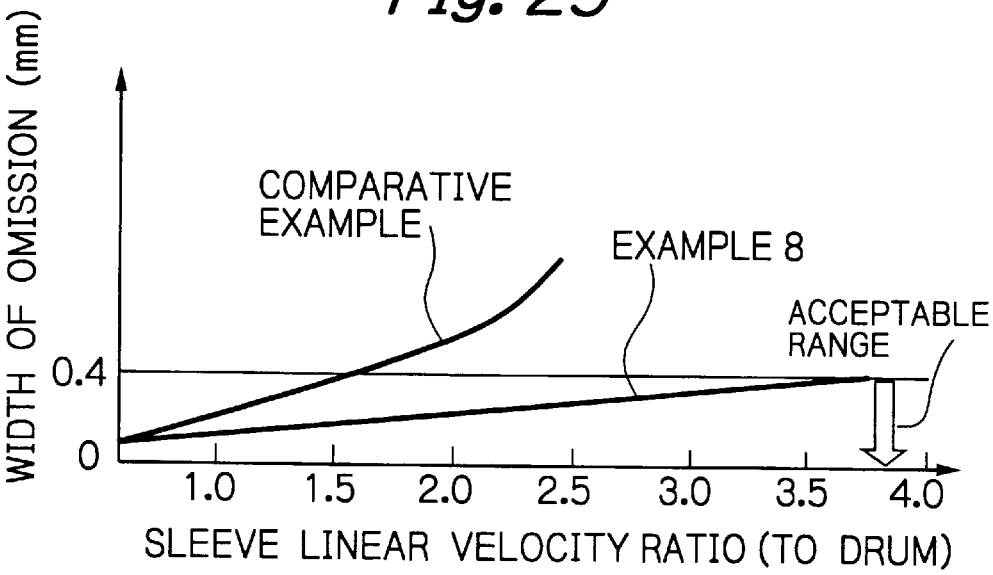
FIG. 25 is a graph showing a relation between the linear speed ratio of the sleeve to a photoconductive drum and the width of the omission of a trailing edge as determined by Example 8.
Figure 26:
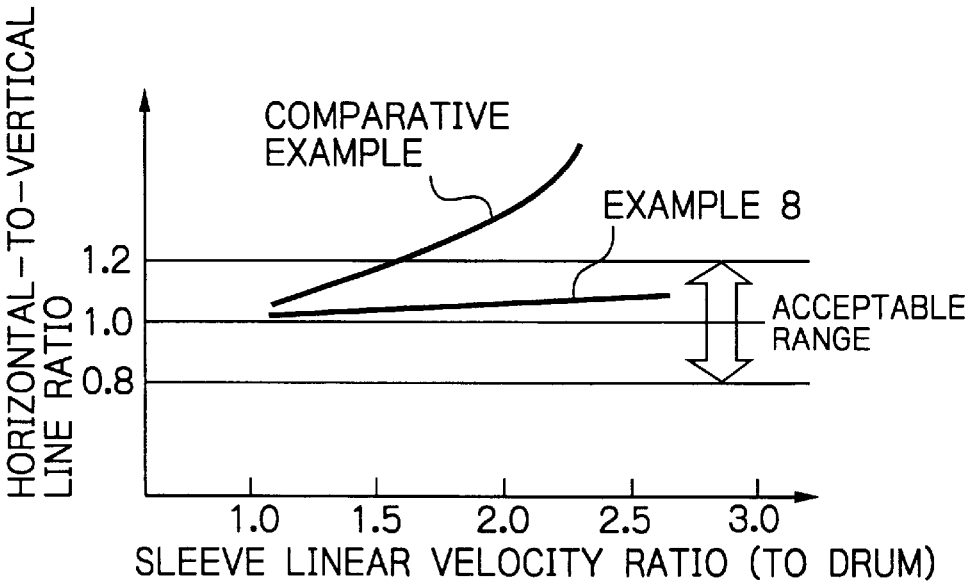
FIG. 26 is a graph showing a relation between the linear speed ratio and the horizontal-to-vertical line ratio as also determined by Example 8.

Example 8 pertains to a relation between the ratio of the linear velocity of the sleeve 4 to that of the drum 1 and the omission of a trailing edge and horizontal-to-vertical line ratio. As FIGS. 25 and 26 indicate, when the above ratio was 3.7 or below, the omission of a trailing edge and the thinning of a horizontal line were surely reduced to an acceptable range with the magnetic toner. By contrast, a comparative example using nonmagnetic toner made the above defects critical when the ratio exceeded 1.5.

Figure 27:
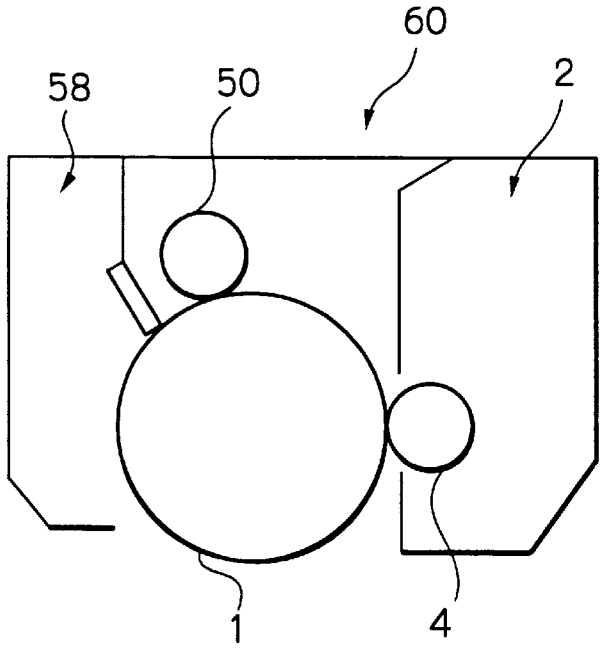
FIG. 27 is a view showing a specific configuration of a process cartridge to which the illustrative embodiment is applied.

In the illustrative embodiment, at least one of the drum 1, charge roller 50 and cleaning device 58 and the developing device 2 may be constructed into a single process cartridge removably mounted to the printer body. FIG. 27 shows a specific configuration of the process unit. As shown, the process unit, generally 60, includes the drum 1, charge roller 50, cleaning device 58, and developing device 2.

The illustrative embodiment has concentrated on an image forming apparatus of the type directly transferring a toner image from a photoconductive element to a sheet. The present invention is similarly applicable to an image forming apparatus of the type transferring a toner image from a photoconductive element to a sheet by way of an intermediate image transfer body. One of image forming apparatuses of this type is a color image forming apparatus that transfers toner images of different colors from a photoconductive element to an intermediate image transfer body one above the other with a primary image transfer unit and then transfers the resulting composite color image to a sheet with a secondary image transfer unit. Another image forming apparatus of the type described is a tandem image forming apparatus including a plurality of image forming units arranged side by side along a linear intermediate image transfer belt. Primary image transfer units each transfer a toner image of a particular color from the associated photoconductive element to the belt. A secondary image transfer unit transfers the resulting composite color image from the belt to a sheet.

While the illustrative embodiment has been shown and described in relation to a printer and a developing device thereof, the present invention is, of course, applicable to any other image forming apparatus, e.g., a copier or a facsimile apparatus and a developing device thereof.

In summary, it will be seen that the present invention provides an image forming apparatus having various unprecedented advantages, as enumerated below.

(1) Magnetic toner grains are attracted by magnetic grains by a magnetic force and are therefore prevented from being scattered around even when a developer carrier moves at a high linear velocity. Further, toner drift occurs little. This, coupled with the fact that a developer forming a magnet brush in a developing region uniformly contacts the developer carrier over the entire axial length of the developer carrier, obviates defective images even when the developer carrier moves at a high speed.

(2) The apparatus does not need a toner content sensor or a paddle screw or similar agitator and therefore simplifies a toner replenishing device. In addition, a minimum amount of magnetic grains suffices, compared to the conventional developing system using a two-ingredient type developer, noticeably reducing a torque required of the apparatus. The apparatus is therefore small size and low cost.

(3) A second metering member implemented as a predoctor stably controls the toner content of the developer on the developer carrier to a preselected range.

(4) The apparatus obviates the fall of image density ascribable to short developing ability and the deposition of the magnetic grains on an image carrier while reducing toner scattering and background contamination.

(5) When the magnetic substance content of the toner is between 10% by mass and 50% by mass, the apparatus surely obviates toner scattering.

(6) The omission of a trailing edge and other defects ascribable to toner drift are surely obviated.

(7) Images with high resolution and with a minimum of granularity are achievable. In addition, the probability that the magnetic grains deposit on background is noticeably reduced.

Various modifications will become possible for those skilled in the art after receiving the teachings of the present disclosure without departing from the scope thereof.

What is claimed is:

1. A developing device for developing a latent image formed on an image carrier, comprising:

a rotatable developer carrier formed of a nonmagnetic material; and magnetic field forming means for causing, in a developing region where said developer carrier faces the image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of the image carrier in a same direction as and in contact with said surface of said image carrier, thereby developing the latent image, the toner of the developer is magnetic toner, and flux density set up in the developing region outside of the surface of said developer carrier in a normal direction has an attenuation ratio of 50% or above.

2. The developing device as claimed in claim 1, wherein the toner content of the developer is between 4% by mass and 20% by mass.

3. The developing device as claimed in claim 2, wherein the toner comprises resin containing 10% by mass to 50% by mass of magnetic material.

4. The developing device as claimed in claim 3, wherein the surface of said developer carrier moves at a speed of 550 mm/sec or below.

5. The developing device as claimed in claim 4, wherein the toner has a weight mean grain size of 4 $\mu$m to 15 $\mu$m.

6. The developing device as claimed in claim 4, wherein a bias for development applied to said developer carrier contains an AC component.

7. The developing device as claimed in claim 1, wherein a difference between a bias for development applied to said developer carrier and a background potential of the image carrier is 400 V or less in absolute value.

8. The developing device as claimed in claim 1, wherein a ratio of a moving speed of the surface of said developer carrier to a moving speed of the surface of the image carrier is 3.7 or below.

9. The developing device as claimed in claim 1, wherein the toner comprises resin containing 10% by mass to 50% by mass of magnetic material.

10. The developing device as claimed in claim 9, wherein the surface of said developer carrier moves at a speed of 550 mm/sec or below.

11. The developing device as claimed in claim 10, wherein the toner has a weight mean grain size of 4 $\mu$m to 15 $\mu$m.

12. The developing device as claimed in claim 10, wherein a bias for development applied to said developer carrier contains an AC component.

13. The developing device as claimed in claim 1, wherein the toner has a weight mean grain size of 4 $\mu$m to 15 $\mu$m.

14. The developing device as claimed in claim 1, wherein a difference between a bias for development applied to said developer carrier and a background potential of the image carrier is 400 V or less in absolute value.

15. The developing device as claimed in claim 14, wherein the toner has a weight mean grain size of 4 $\mu$m to 15 $\mu$m.

16. The developing device as claimed in claim 14, wherein a bias for development applied to said developer carrier contains an AC component.

17. The developing device as claimed in claim 1, wherein a ratio of a moving speed of the surface of said developer carrier to a moving speed of the surface of the image carrier is 3.7 or below.

18. The developing device as claimed in claim 17, wherein a bias for development applied to said developer carrier contains an AC component.

19. The developing device as claimed in claim 1, wherein a bias for development applied to said developer carrier contains an AC component.

20. A developing device for developing a latent image formed on an image carrier, comprising:

a rotatable developer carrier formed of a nonmagnetic material; and magnetic field forming means for causing, in a developing region where said developer carrier faces the image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of the image carrier in a same direction as and in contact with said surface of said image carrier, thereby developing the latent image, the toner of the developer is magnetic toner, and flux density set up in the developing region outside of the surface of said developer carrier in a normal direction has an angle of 40° or below between opposite 0 mT polarity transition points, as seen from an axis of said developer carrier, in a direction in which said surface of said developer carrier moves.

21. The developing device as claimed in claim 20, wherein the toner content of the developer is between 4% by mass and 20% by mass.

22. The developing device as claimed in claim 21, wherein the toner comprises resin containing 10% by mass to 50% by mass of magnetic material.

23. The developing device as claimed in claim 22, wherein the surface of said developer carrier moves at a speed of 550 mm/sec or below.

24. The developing device as claimed in claim 23, wherein the toner has a weight mean grain size of 4 $\mu$m to 15 $\mu$m.

25. The developing device as claimed in claim 23, wherein a bias for development applied to said developer carrier contains an AC component.

26. The developing device as claimed in claim 20, wherein a difference between a bias for development applied to said developer carrier and a background potential of the image carrier is 400 V or less in absolute value.

27. The developing device as claimed in claim 20, wherein a ratio of a moving speed of the surface of said developer carrier to a moving speed of the surface of the image carrier is 3.7 or below.

28. The developing device as claimed in claim 20, wherein the toner comprises resin containing 10% by mass to 50% by mass of magnetic material.

29. The developing device as claimed in claim 28, wherein the surface of said developer carrier moves at a speed of 550 mm/sec or below.

30. The developing device as claimed in claim 29, wherein the toner has a weight mean grain size of 4 μm to 15 μm.

31. The developing device as claimed in claim 29, wherein a bias for development applied to said developer carrier contains an AC component.

32. The developing device as claimed in claim 20, wherein the toner has a weight mean grain size of 4 μm to 15 μm.

33. The developing device as claimed in claim 20, wherein a difference between a bias for development applied to said developer carrier and a background potential of the image carrier is 400 V or less in absolute value.

34. The developing device as claimed in claim 33, wherein the toner has a weight mean grain size of 4 μm to 15 μm.

35. The developing device as claimed in claim 33, wherein a bias for development applied to said developer carrier contains an AC component.

36. The developing device as claimed in claim 20, wherein a ratio of a moving speed of the surface of said developer carrier to a moving speed of the surface of the image carrier is 3.7 or below.

37. The developing device as claimed in claim 36, wherein a bias for development applied to said developer carrier contains an AC component.

38. The developing device as claimed in claim 20, wherein the toner has a weight mean grain size of 4 μm to 15 μm.

39. The developing device as claimed in claim 20, wherein a bias for development applied to said developer carrier contains an AC component.

40. A developing device for developing a latent image formed on an image carrier, comprising:

a rotatable developer carrier formed of a nonmagnetic material; and magnetic field forming means for causing, in a developing region where said developer carrier faces the image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of the image carrier in a same direction as and in contact with said surface of said image carrier, thereby developing the latent image, the toner of the developer is magnetic toner, and flux density set up in the developing region outside of the surface of said developer carrier in a normal direction has an angular half-width of 20° or below, as seen from an axis of said developer carrier, in a direction in which said surface of said developer carrier moves.

41. The developing device as claimed in claim 40, wherein the toner content of the developer is between 4% by mass and 20% by mass.

42. The developing device as claimed in claim 41, wherein the toner comprises resin containing 10% by mass to 50% by mass of magnetic material.

43. The developing device as claimed in claim 42, wherein the surface of said developer carrier moves at a speed of 550 mm/sec or below.

44. The developing device as claimed in claim 43, wherein the toner has a weight mean grain size of 4 μm to 15 μm.

45. The developing device as claimed in claim 43, wherein a bias for development applied to said developer carrier contains an AC component.

46. The developing device as claimed in claim 40, wherein a difference between a bias for development applied to said developer carrier and a background potential of the image carrier is 400 V or less in absolute value.

47. The developing device as claimed in claim 40, wherein a ratio of a moving speed of the surface of said developer carrier to a moving speed of the surface of the image carrier is 3.7 or below.

48. The developing device as claimed in claim 40, wherein the toner content of the developer is between 4% by mass and 20% by mass.

49. The developing device as claimed in claim 48, wherein the toner comprises resin containing 10% by mass to 50% by mass of magnetic material.

50. The developing device as claimed in claim 49, wherein the surface of said developer carrier moves at a speed of 550 mm/sec or below.

51. The developing device as claimed in claim 50, wherein the toner has a weight mean grain size of 4 μm to 15 μm.

52. The developing device as claimed in claim 50, wherein a bias for development applied to said developer carrier contains an AC component.

53. The developing device as claimed in claim 40, wherein the toner has a weight mean grain size of 4 μm to 15 μm.

54. The developing device as claimed in claim 40, wherein a difference between a bias for development applied to said developer carrier and a background potential of the image carrier is 400 V or less in absolute value.

55. The developing device as claimed in claim 54, wherein the toner has a weight mean grain size of 4 μm to 15 μm.

56. The developing device as claimed in claim 54, wherein a bias for development applied to said developer carrier contains an AC component.

57. The developing device as claimed in claim 40, wherein a ratio of a moving speed of the surface of said developer carrier to a moving speed of the surface of the image carrier is 3.7 or below.

58. The developing device as claimed in claim 57, wherein a bias for development applied to said developer carrier contains an AC component.

59. The developing device as claimed in claim 40, wherein the toner has a weight mean grain size of 4 μm to 15 μm.

60. The developing device as claimed in claim 40, wherein a bias for development applied to said developer carrier contains an AC component.

61. An image forming apparatus comprising:

an image carrier;

latent image forming means for forming a latent image on said image carrier;

a developing device for developing the latent image to thereby produce a corresponding toner image; and an image transferring device for transferring the toner image from said image carrier to a recording medium;

said developing device comprising:

a rotatable developer carrier formed of a nonmagnetic material; and magnetic field forming means for causing, in a developing region where said developer carrier faces said image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of said image carrier in a same direction as and in contact with said surface of said image carrier, thereby developing the latent image, the toner of the developer is magnetic toner, and flux density set up in the developing region outside of the surface of said developer carrier in a normal direction has an attenuation ratio of 50% or above.

62. An image forming apparatus comprising:

an image carrier;

latent image forming means for forming a latent image on said image carrier;

a developing device for developing the latent image to thereby produce a corresponding toner image; and an image transferring device for transferring the toner image from said image carrier to a recording medium;

said developing device comprising:

a rotatable developer carrier formed of a nonmagnetic material; and magnetic field forming means for causing, in a developing region where said developer carrier faces said image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of said image carrier in a same direction as and in contact with said surface of said image carrier, thereby developing the latent image, the toner of the developer is magnetic toner, and flux density set up in the developing region outside of the surface of said developer carrier in a normal direction has an angle of 40° or below between opposite 0 mT polarity transition points, as seen from an axis of said developer carrier, in a direction in which said surface of said developer carrier moves.

63. An image forming apparatus comprising:

an image carrier;

latent image forming means for forming a latent image on said image carrier;

a developing device for developing the latent image to thereby produce a corresponding toner image; and an image transferring device for transferring the toner image from said image carrier to a recording medium;

said developing device comprising:

a rotatable developer carrier formed of a nonmagnetic material; and magnetic field forming means for causing, in a developing region where said developer carrier faces said image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of said image carrier in a same direction as and in contact with said surface of said image carrier, thereby developing the latent image, the toner of the developer is magnetic toner, and flux density set up in the developing region outside of the surface of said developer carrier in a normal direction has an angular half-width of 200 or below, as seen from an axis of said developer carrier, in a direction in which said surface of said developer carrier moves.

64. An image forming apparatus comprising:

an image carrier;

latent image forming means for forming a latent image on said image carrier;

a developing device for developing the latent image to thereby produce a corresponding toner image;

an intermediate image transfer body to which the toner image is transferred from said image carrier;

a primary image transferring device for transferring the toner image from said image carrier to said intermediate image transfer body; and a secondary image transferring device for transferring the toner image from said intermediate image transfer body to a recording medium;

said developing device comprising:

a rotatable developer carrier formed of a nonmagnetic material; and magnetic field forming means for causing, in a developing region where said developer carrier faces said image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of said image carrier in a same direction as and in contact with said surface of said image carrier, thereby developing the latent image, the toner of the developer is magnetic toner, and flux density set up in the developing region outside of the surface of said developer carrier in a normal direction has an attenuation ratio of 50% or above.

65. An image forming apparatus comprising:

an image carrier;

latent image forming means for forming a latent image on said image carrier;

a developing device for developing the latent image to thereby produce a corresponding toner image;

an intermediate image transfer body to which the toner image is transferred from said image carrier;

a primary image transferring device for transferring the toner image from said image carrier to said intermediate image transfer body; and a secondary image transferring device for transferring the toner image from said intermediate image transfer body to a recording medium;

said developing device comprising:

a rotatable developer carrier formed of a nonmagnetic material; and magnetic field forming means for causing, in a developing region where said developer carrier faces said image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of said image carrier in a same direction as and in contact with said surface of said image carrier, thereby developing the latent image, the toner of the developer is magnetic toner, and flux density set up in the developing region outside of the surface of said developer carrier in a normal direction has an angle of 40° or below between opposite 0 mT polarity transition points, as seen from an axis of said developer carrier, in a direction in which said surface of said developer carrier moves.

66. An image forming apparatus comprising:

an image carner;

latent image forming means for forming a latent image on said image carrier;

a developing device for developing the latent image to thereby produce a corresponding toner image;

an intermediate image transfer body to which the toner image is transferred from said image carrier;

a primary image transferring device for transferring the toner image from said image carrier to said intermediate image transfer body; and a secondary image transferring device for transferring the toner image from said intermediate image transfer body to a recording medium;

said developing device comprising:

a rotatable developer carrier formed of a nonmagnetic material; and magnetic field forming means for causing, in a developing region where said developer carrier faces the image carrier, a developer made up of toner and magnetic grains to rise on said developer carriers in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of the image carrier in a same direction as and in contact with said surface of said image carrier, thereby developing the latent image, the toner of the developer is magnetic toner, and flux density set up in the developing region outside of the surface of said developer carrier in a normal direction has an angular half-width of 20° or below, as seen from an axis of said developer carrier, in a direction in which said surface of said developer carrier moves.

67. In an image forming process unit removably mounted to a body of an image forming apparatus and including at least one of an image carrier, a charger for uniformly charging a surface of said image carrier and a cleaning device for cleaning said surface of said image carrier and a developing device for developing a latent image, which is formed on said image carrier, to thereby produce a corresponding toner image, said developing device comprising:

a rotatable developer carrier formed of a nonmagnetic material;

magnetic field forming means for causing, in a developing region where said developer carrier faces said image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of said image carrier in a same direction as and in contact with said surface of said image carrier, thereby developing the latent image, the toner of the developer is magnetic toner, and flux density set up in the developing region outside of the surface of said developer carrier in a normal direction has an attenuation ratio of 50% or above.

68. In an image forming process unit removably mounted to a body of an image forming apparatus and including at least one of an image carrier, a charger for uniformly charging a surface of said image carrier and a cleaning device for cleaning said surface of said image carrier and a developing device for developing a latent image, which is formed on said image carrier, to thereby produce a corresponding toner image, said developing device comprising:

a rotatable developer carrier formed of a nonmagnetic material;

magnetic field forming means for causing, in a developing region where said developer carrier faces said image carrier, a developer made up of toner and magnetic grains to rise on said developer carrier in a form of a magnet brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of said image carrier in a same direction as and in contact with said surface of said image carrier, thereby developing the latent image, the toner of the developer is magnetic toner, and flux density set up in the developing region outside of the surface of said developer carrier in a normal direction has an angle of 40° or below between opposite 0 mT polarity transition points, as seen from an axis of said developer carrier, in a direction in which said surface of said developer carrier moves.

69. In an image forming process unit removably mounted to a body of an image forming apparatus and including at least one of an image carrier, a charger for uniformly charging a surface of said image carrier and a cleaning device for cleaning said surface of said image carrier and a developing device for developing a latent image, which is formed on said image carrier, to thereby produce a corresponding toner image, said developing device comprising:

a rotatable developer carrier formed of a nonmagnetic material;

magnetic field forming means for causing, in a developing region where said developer carrier faces the image carrier, a developer made up of toner and magnetic grains to rise on said developer carrier in a form of a magnet-brush;

a developer case for housing said magnetic field forming means, the developer case including a first doctor member, a predoctor member, and a developer chamber between said first doctor member and said predoctor member, said predoctor member extending toward said first doctor member at a doctoring end for shaving off an upper portion of the developer such that the shaved-off developer accumulates at a position upstream of said predoctor member, and such that during operation a point of accumulation of the shaved-off developer is substantially at an upstream edge of a port defined by said predoctor member and a toner hopper;

wherein in the developing region the magnet brush on a surface of said developer carrier is caused to move at a higher speed than a surface of the image carrier in a same direction as and in contact with said surface of said image carrier, thereby developing the latent image, the toner of the developer is magnetic toner, and flux density set up in the developing region outside of the surface of said developer carrier in a normal direction has an angular half-width of 20° or below, as seen from an axis of said developer carrier, in a direction in which said surface of said developer carrier moves.

* * * * *